US011027549B2

(12) United States Patent
Kinokuni

(10) Patent No.: US 11,027,549 B2
(45) Date of Patent: Jun. 8, 2021

(54) BONDING STRUCTURE, HEAD MODULE, HEAD DEVICE, AND LIQUID DISCHARGE APPARATUS

(71) Applicant: Takashi Kinokuni, Tokyo (JP)

(72) Inventor: Takashi Kinokuni, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/697,381

(22) Filed: Nov. 27, 2019

(65) Prior Publication Data

US 2020/0171829 A1 Jun. 4, 2020

(30) Foreign Application Priority Data

Nov. 30, 2018 (JP) ..... JP2018-225454
Jun. 11, 2019 (JP) ..... JP2019-108753

(51) Int. Cl.
*B41J 2/14* (2006.01)
*B41J 2/16* (2006.01)

(52) U.S. Cl.
CPC ..... *B41J 2/14201* (2013.01); *B41J 2/1623* (2013.01); *B41J 2202/20* (2013.01)

(58) Field of Classification Search
CPC ..... B41J 2/1623
See application file for complete search history.

(56) References Cited

U.S. PATENT DOCUMENTS

2014/0009544 A1* 1/2014 Koda ..... B41J 2/1623 347/94
2019/0263157 A1 8/2019 Miyazaki
2019/0283416 A1 9/2019 Kinokuni

FOREIGN PATENT DOCUMENTS

JP 11-105282 4/1999
JP 2008-094000 4/2008
JP 2010201781 9/2010

* cited by examiner

*Primary Examiner* — Julian D Huffman
(74) *Attorney, Agent, or Firm* — Harness, Dickey & Pierce, P.L.C.

(57) ABSTRACT

A bonding structure includes a first part including a first bonding surface and a second part including a second bonding surface to be bonded to the first bonding surface of the first part with a first adhesive and a second adhesive different from the first adhesive. At least one of the first bonding surface and the second bonding surface includes a first region on which the first adhesive is applied, a second region on which the second adhesive is applied, and a third region disposed between the first region and the second region, the third region having a water repellency higher than a water repellency of each of the first region and the second region.

14 Claims, 18 Drawing Sheets

BONDING STRUCTURE, HEAD MODULE, HEAD DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-225454, filed on Nov. 30, 2018 in the Japan Patent Office and Japanese Patent Application No. 2019-108753, filed on Jun. 11, 2019 in the Japan Patent Office, the entire disclosures of which are hereby incorporated by reference herein.

BACKGROUND

Technical Field

Aspects of the present disclosure relate to a bonding structure, a head module, a head device, and a liquid discharge apparatus including the head device.

Related Art

When bonding parts of an inkjet head, adhesives having various resistances to ink are used to bond the parts of the inkjet head to prevent ink from entering into the bonded parts from interfaces of the adhesives and the parts.

For example, an adhesive for temporary bonding and an adhesive for main bonding are used to bond two parts.

SUMMARY

In an aspect of this disclosure, a bonding structure includes a first part including a first bonding surface and a second part including a second bonding surface to be bonded to the first bonding surface of the first part with a first adhesive and a second adhesive different from the first adhesive. At least one of the first bonding surface and the second bonding surface includes a first region on which the first adhesive is applied, a second region on which the second adhesive is applied, and a third region disposed between the first region and the second region, the third region having a water repellency higher than a water repellency of each of the first region and the second region.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
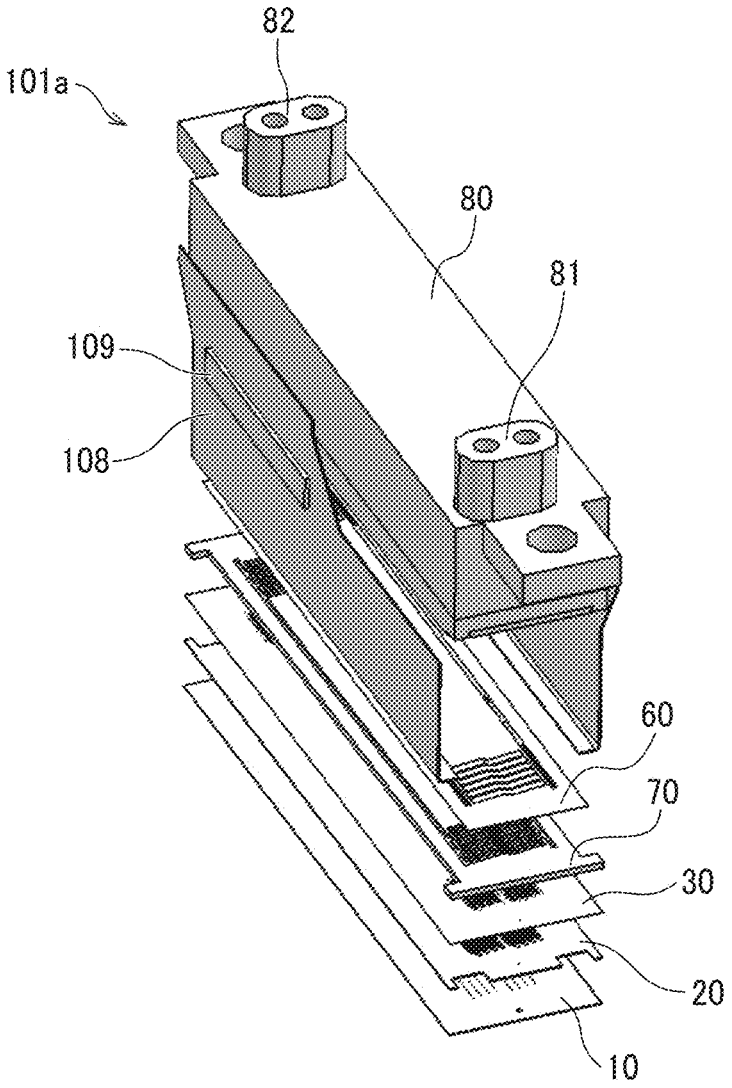
FIG. 1 is an exploded perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring to the drawings, embodiments according to the present disclosure is described below. Further, some of description and drawings may be appropriately omitted or simplified in order to clarify the description. In each of the drawings, the same reference codes are allocated to components or portions having the same structure, and redundant descriptions of the same parts may be omitted.

Adhesives having various resistances to ink are used to bond parts of an inkjet head. Hereinafter, an "inkjet head" or a "liquid discharge head" is simply referred to as a "head". A material that seals an interface between parts has to be exposed to a high temperature environment for curing in bonding technique using a conventional adhesive. In the above-described bonding technique, misalignment between parts may occur after curing when the parts having different linear expansion coefficients are bonded together.

Further, even when the linear expansion coefficients between parts are made uniform, a flatness of the parts to be bonded is about several tens of microns. A dispenser is selected as an application means to selectively apply the adhesive to a partial area of the parts of the head. An amount of adhesive applied to the parts by the dispenser is relatively greater than an amount of adhesive applied to the parts by other application means. Thus, a misalignment between parts increases in a high-temperature environment. The misalignment between the parts occurs at time of curing shrinkage of the adhesive by a slight deviation in an amount of adhesive applied on the parts. Thus, the misalignment between the parts may occur.

Thus, an adhesive that cures in a high temperature environment may be used after the positions of the parts are fixed once with an adhesive that cures in a room temperature to fix positions of the parts and to prevent the ink from entering into the parts from an interface between the parts. In the bonding procedure in the above-described case, first, both adhesives are applied on one part surface, and then another part is stacked on one part surface from above.

However, the region onto which the adhesive is applied is required to be a narrow region in view of a head layout. Thus, a problem may occur such as mixing of the adhesives before curing that cause poor adhesion in a subsequent curing process.

A bonding structure according to a first embodiment of the present disclosure bonds two parts of the head using different types of adhesives. The bonding structure improves an accuracy of bonding. The bonding structure has a liquid contact resistance and fixes positions of two parts of the head with high accuracy.

The bonding structure of the first embodiment includes a first part and a second part bonded by a first adhesive and a second adhesive different from the first adhesive, for example. Here, the first part and the second part are bonded such that a bonding surface of the first part (hereinafter also referred to as "first bonding surface") on which the first part is bonded to the second part, and a bonding surfaces of the second part (hereinafter also referred to as "second bonding surface") on which the second part is bonded to the first part with the first adhesive and the second adhesive.

Further, at least one of the first bonding surface and the second bonding surface includes a first region, a second region, and a third region. The first region is a region onto which the first adhesive is applied. The second region is a region onto which the second adhesive is applied. The third region is a region provided between the first region and the second region to separate the first adhesive from the second adhesive. The third region is a region having a water repellency higher than a water repellency of each of the first region and the second region.

For example, two types of adhesives are used to bond the first part and the second part. The two types of adhesives includes an adhesive cured in a room temperature environment that bonds the parts of the head and an adhesive cured in a high temperature environment that prevents ink from entering into the parts of the head.

A "non-water-repellent surface as an application area of an adhesive" and a "water-repellent surface as a non-application area of an adhesive" are formed at least one of the first bonding surface and the second bonding surface as the part surface onto which the adhesive is applied. The water-repellent surface divides the non-water-repellent surface. The adhesive is not applied on the water-repellent surface (non-application area). Two types of adhesives are separately applied to the non-water-repellent surface divided by the water-repellent surface.

Thus, one of the adhesive among the two types of adhesives applied on the parts is first cured in a room temperature environment to fix the position of the parts with high precision. Then, another adhesive is cured in a high temperature environment to form a sealing surface with liquid resistance. Thus, the two types of adhesives can achieve liquid resistance and fix the positions of the parts with high precision. Further, the two types of adhesives can prevent mixing of the adhesives that causes bonding failure.

Thus, the bonding structure according to the present disclosure forms a non-water-repellent surface in each of the application areas onto which a plurality of different types of adhesives is applied. Further, a water-repellent film (water-repellent surface) partitions each of the application areas onto which the non-water-repellent surface is formed. Thus, the bonding structure can prevent mixing of adhesives applied on the application area.

Next, a first embodiment of the present disclosure as described above is described below in detail with reference to the drawings. In each of the following embodiments, the bonding structure according to the first embodiment of the present disclosure is applied to a head module included in a liquid discharge apparatus (for example, an inkjet printer) that discharges liquid. In each of the following embodiments, a nozzle cover is used as the first part, and a nozzle plate or actuator substrate is used as the second part. Further, in each of the following embodiments, the first part is the nozzle cover, and the water-repellent film is formed on at least a part of the nozzle cover. Further, in each of the following embodiments, the second part is the nozzle plate, and the water-repellent film is formed on at least a part of the nozzle plate.

In another embodiment, the nozzle cover may be used as the second part, and the nozzle plate or actuator substrate may be used as the first part. Further, the second part may be the nozzle cover, and the water-repellent film is formed on at least a part of the nozzle cover. Further, the first part may be the nozzle plate, and the water-repellent film is formed on at least a part of the nozzle plate.

The head module includes at least one head attached to a cover and a base. A head device includes a group of a plurality of head modules.

Figure 2:
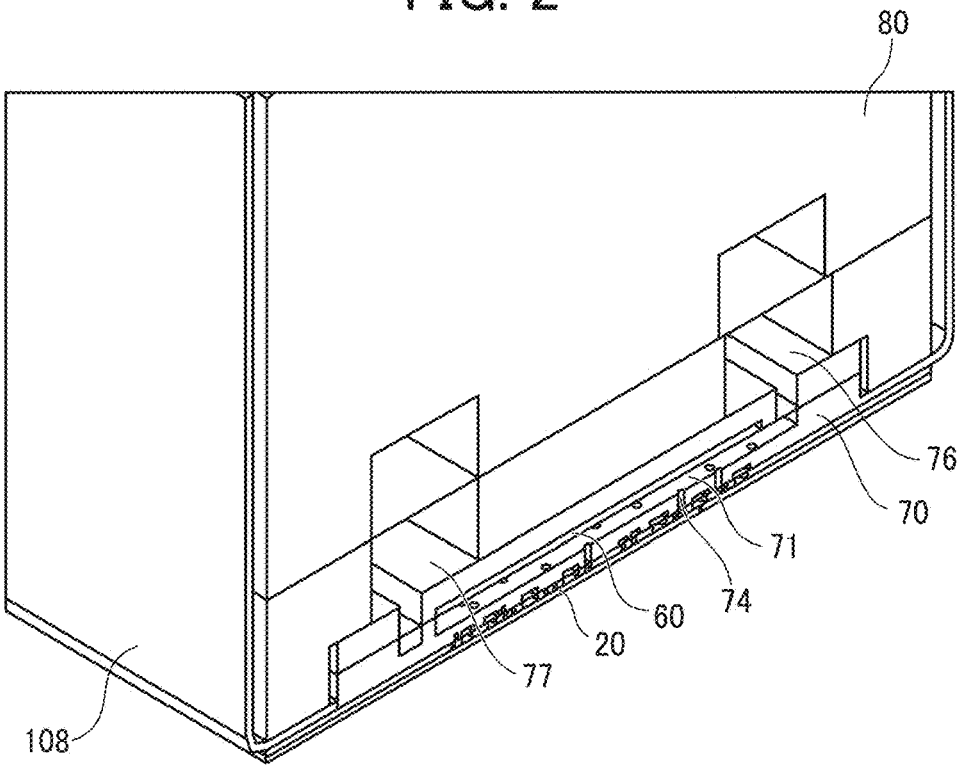
FIG. 2 is a schematic cross-sectional perspective view of the liquid discharge head according to the first embodiment.
Figure 3:
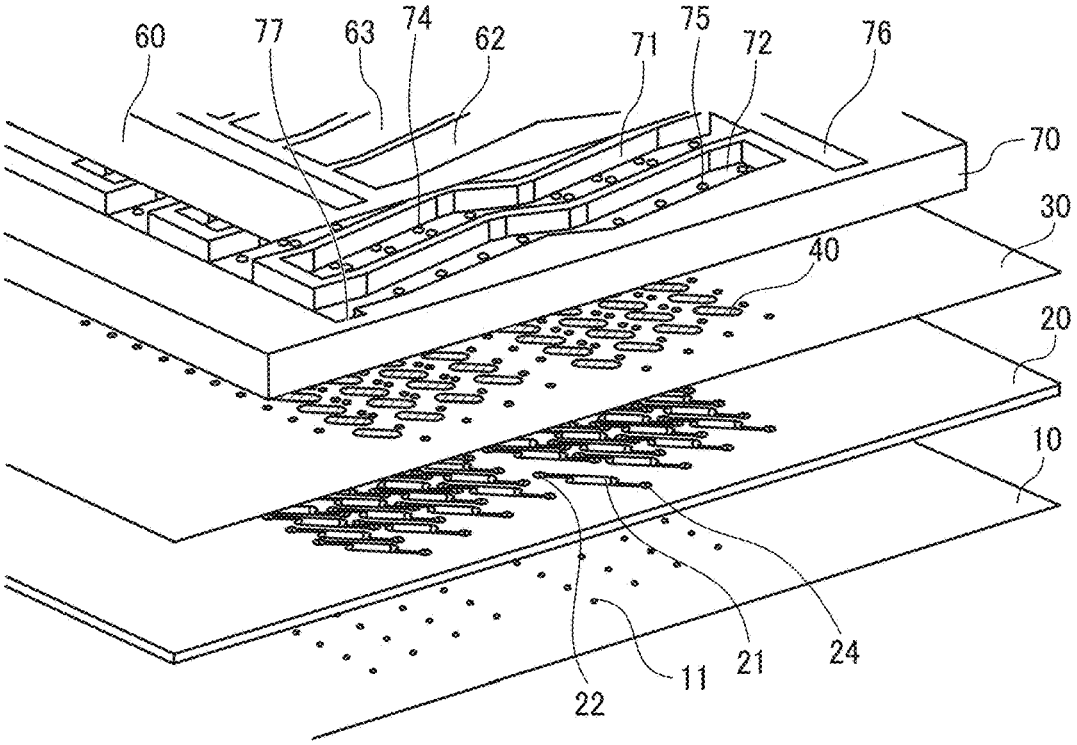
FIG. 3 is an exploded perspective view of the liquid discharge head without a frame in the first embodiment.

Next, the head according to a first embodiment of the present disclosure is described with reference to FIGS. 1 to 3. FIG. 1 is an exploded perspective view of the head according to the first embodiment. FIG. 2 is a cross-sectional perspective view of the head according to the first embodiment. FIG. 3 is an exploded perspective view of the head according to the first embodiment without a frame of FIG. 2.

The liquid discharge head 101*a* includes a nozzle plate 10, an individual channel plate 20 (individual channel member), a diaphragm 30 (diaphragm member), a common channel member 70, a damper 60, a frame 80, a flexible wiring substrate 108 that is a substrate on which a drive circuit 109 is mounted, and the like.

The individual channel plate 20 and the diaphragm 30 constitute an actuator substrate 4-2 in FIG. 5 described below.

The common channel member 70 and the damper 60 constitute a channel plate 4-1 as illustrated below in FIG. 5. The channel plate 4-1 is also referred to as a common channel member.

The frame 80 constitutes a housing as illustrated below in FIG. 5.

The nozzle plate 10 includes a plurality of nozzles 11 to discharge a liquid.

The individual channel plates 20 includes a plurality of individual chambers 21, a plurality of supply-side individual channels 22, and a plurality of recovery-side individual channels 24. The plurality of individual chambers 21 communicates with the plurality of nozzles 11, respectively. The plurality of supply-side individual channels 22 communicates with the plurality of individual chambers 21, respectively. The plurality of recovery-side individual channels 24 communicates with the plurality of individual chambers 21, respectively. The plurality of supply-side individual channels 22 and the plurality of recovery-side individual channels 24 are described below with reference to FIG. 18.

The diaphragm 30 forms a diaphragm plate that serves as a deformable wall of the individual chamber 21, and the piezoelectric element 40 is integrally provided on the diaphragm 30 (see FIG. 3). The piezoelectric element 40 is pressure generator that deforms the diaphragm 30 and pressurizes the liquid in the individual chamber 21.

Note that the individual channel plate 20 and the diaphragm 30 are not limited to separate members. For example, an identical member such as a Silicon on Insulator (SOI) substrate may be used to form the individual channel plate 20 and the diaphragm 30 in a single body. That is, an SOI substrate formed by sequentially film-forming a silicon oxide film, a silicon layer, and a silicon oxide film on a silicon substrate is used. The silicon substrate in the SOI substrate forms the individual channel plate 20, and the silicon oxide film, the silicon layer, and the silicon oxide film in the SOI substrate form the diaphragm 30. In the above-described configuration, the layer structure of the silicon oxide film, the silicon layer, and the silicon oxide film in the SOI substrate forms the diaphragm 30. As described above, the diaphragm 30 includes a member made of the material that is film-formed on a surface of the individual channel plate 20.

The common channel member 70 includes a plurality of supply-side common channels 71 (common supply branch channel) and a plurality of recovery-side common channels 72 (common recovery branch channel) arranged alternately adjacent to each other. The plurality of supply-side common channels 71 communicate with two or more individual supply channels. The plurality of recovery-side common channels 72 communicates with two or more individual recovery channels.

The common channel member 70 includes one or more common-supply main channels 76 (see FIGS. 2 and 3) that communicate with the plurality of supply-side common channels 71, and one or more common-recovery main channels 77 (see FIGS. 2 and 3) that communicate with the plurality of recovery-side common channels 72.

The damper 60 includes a supply-side damper 63 that faces (opposes) a supply port 74 of the supply-side common channel 71 and a recovery-side damper 62 that faces (opposes) a recovery port 75 of the recovery-side common channel 72.

Next, a configuration of each embodiments is described below.

First Embodiment

Figure 4:
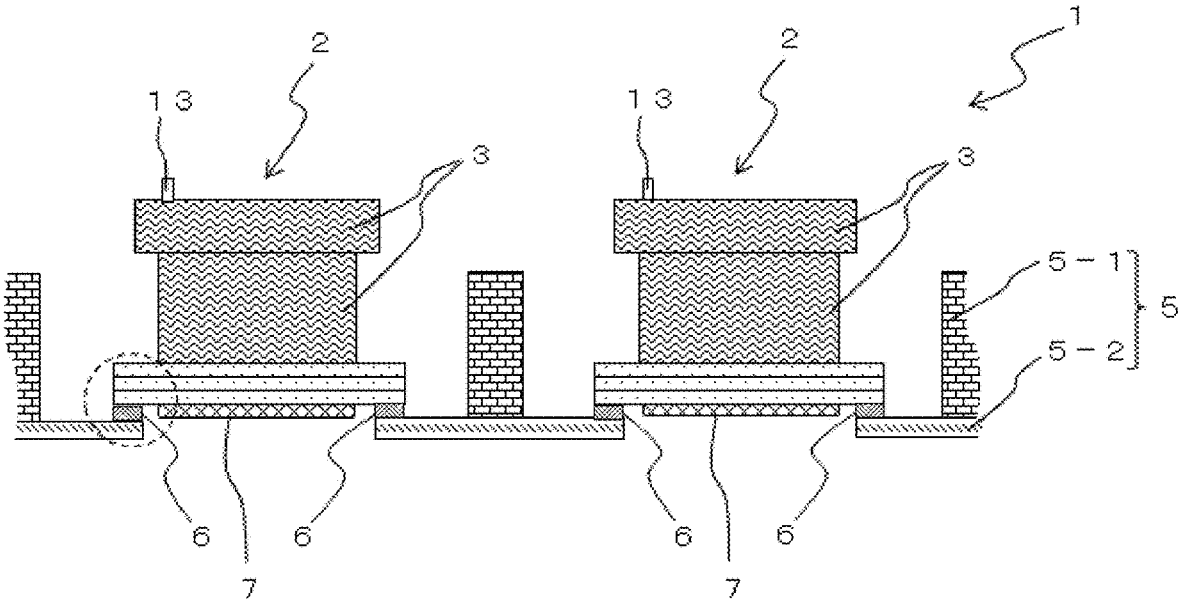
FIG. 4 is a schematic cross-sectional view of an example of a head module that uses a bonding structure according to the first embodiment of the present disclosure.

FIG. 4 is a schematic cross-sectional view of an example of a head module 1 that uses the bonding structure according to a first embodiment of the present disclosure.

FIG. 4 illustrates an example in which the head module 1 includes heads 2 and a base unit 5. The heads 2 are bonded to the base unit 5 with an adhesive 6.

Figure 5:
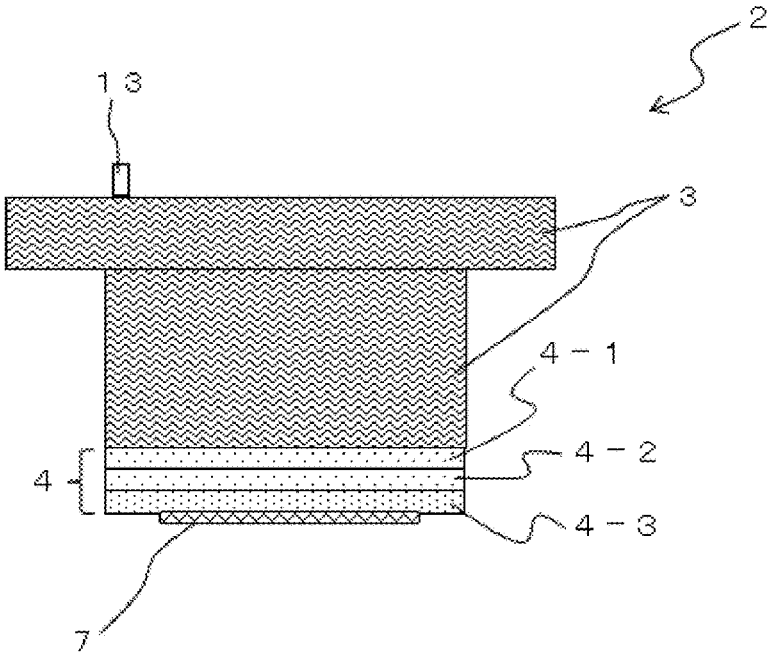
FIG. 5 is a schematic cross-sectional view of an example of the head according to the first embodiment.

FIG. 5 is a schematic cross-sectional view of an example of the head 2 according to the first embodiment.

Figure 6:
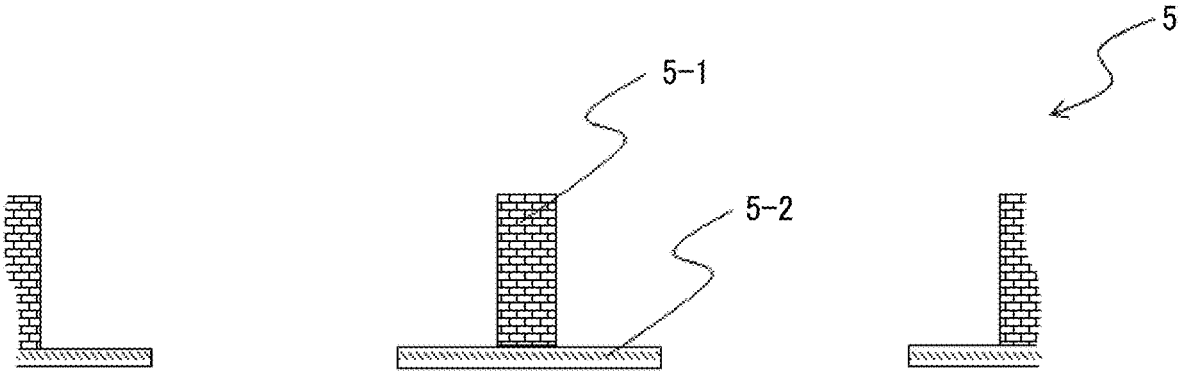
FIG. 6 is a schematic cross-sectional view of an example of the base unit according to the first embodiment.

FIG. 6 is a schematic cross-sectional view of an example of the base unit 5 according to the first embodiment.

The head 2 includes a housing 3 and a chamber part 4. The head 2 is an example of a liquid discharge head.

The chamber part 4 is classified into a channel plate 4-1, an actuator substrate 4-2, and a nozzle plate 4-3. An ink channel through which ink flows is formed inside the chamber part 4 and the housing 3.

The base unit 5 includes the heads 2 arranged in an array. The base unit 5 has a structure in which a base substrate 5-1 and a nozzle cover 5-2 are bonded. The base substrate 5-1 is also referred to as a "base member". The nozzle cover 5-2 is also referred to as a "cover member". Note that the base substrate 5-1 and the nozzle cover 5-2 may be formed of a single part.

Ink as a liquid is supplied from the inlet 13 formed in the housing 3. The ink flow is branched in the channel plate 4-1, and the ink reaches each individual chambers 21 formed by the actuator substrate 4-2 and the nozzle plate 4-3.

The piezoelectric element 40 formed on the actuator substrate 4-2 that forms a part of the individual chamber 21 is driven to reduce a volume in the individual chamber 21. Thus, the ink reached to the individual chamber 21 is discharged from nozzles 11 corresponding to the individual chambers 21. The nozzles 11 are formed in the nozzle plate 4-3.

The nozzle cover 5-2 that is a part of the base unit 5 and the nozzle plate 4-3 that is a part of the head 2 are bonded with the adhesive 6 to fix the base unit 5 and the head 2 in the head module 1 according to the present embodiment.

Each part constituting the chamber part 4 is preferably made of a silicon (Si) single crystal material as a main material that can be finely processed so that the head 2 can accurately discharge the ink with high precision. The housing 3 may be made of a thermoplastic resin to satisfy required functions such as cost and ink resistance.

Each part constituting the base unit 5 is preferably made of an alloy mainly composed of Fe and Ni, and a linear expansion coefficient is preferably substantially the same as a linear expansion coefficient of the Si single crystal material of the chamber part 4.

The nozzle plate 4-3 is subjected to water-repellent treatment to form the water-repellent film 7 from a viewpoint of improving ink discharge performance of the head 2 from the nozzles 11 and preventing contamination of the head 2 by ink. The nozzle cover 5-2 is subjected to water-repellent treatment to form the water-repellent film 7 from a viewpoint of preventing contamination.

Figure 7:
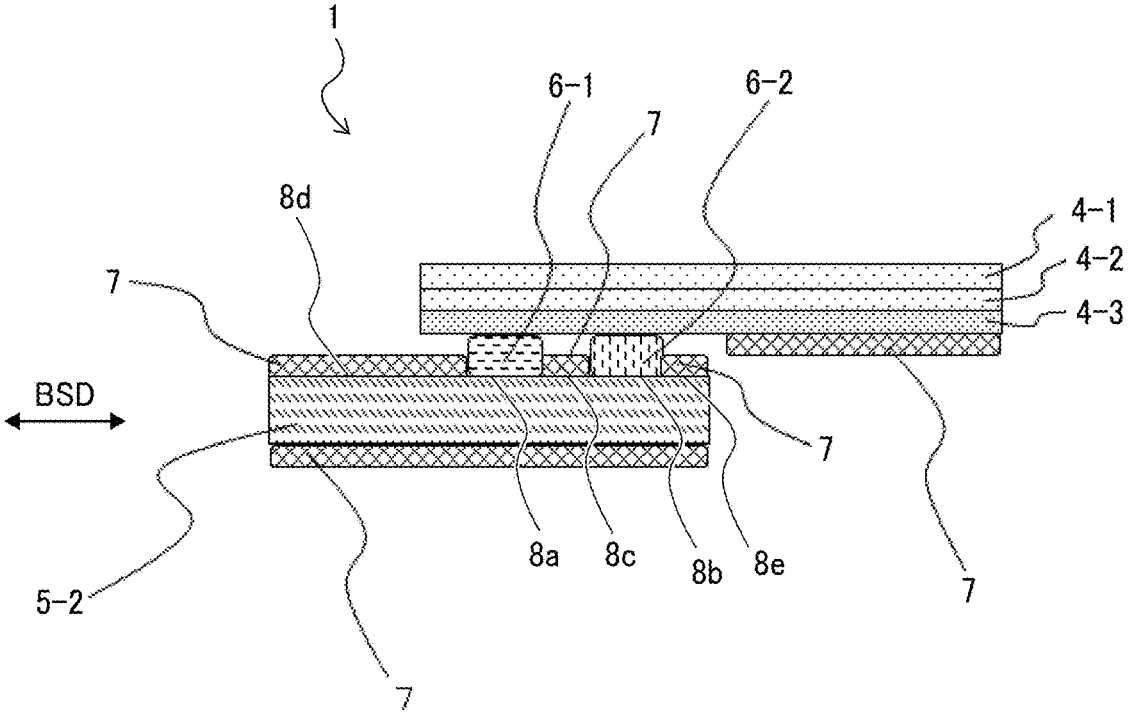
FIG. 7 is an enlarged schematic cross-sectional view of an example of a bonding portion between the head and the base unit of the head module illustrated in FIG. 4.

FIG. 7 is an enlarged schematic cross-sectional view of an example of an adhesion portion between the head and the base unit of the head module illustrated in FIG. 4. The adhesion portion is indicated by a portion surrounded by a circle of broken line in FIG. 4.

The nozzle plate 4-3 of the head 2 and the nozzle cover 5-2 of the base unit 5 are bonded by the adhesive 6. FIG. 7 illustrates an example in which a first adhesive 6-1 and a second adhesive 6-2 having different characteristics are used as the adhesive 6.

For example, the first adhesive 6-1 can be cured in a room temperature environment. The second adhesive 6-2 is cured only in a high temperature environment and has liquid resistance. That is, the first adhesive 6-1 is an adhesive curable in room-temperature, and the second adhesive 6-2 is a thermosetting adhesive. Examples of the first adhesive 6-1 include a UV (ultraviolet) curable adhesive, a synthetic rubber adhesive that cures by evaporation of moisture or a solvent, and an instantaneous adhesive that cures by reacting with moisture. An epoxy thermosetting adhesive may be used as the second adhesive 6-2. The second adhesive 6-2 has ink resistance (corrosion resistance) against solvent-based ink, UV-based ink, water-based ink, and oil-based ink. Hereinafter, when the first adhesive 6-1 and the second adhesive 6-2 are not distinguished, the first adhesive 6-1 and the second adhesive 6-2 are simply referred to as "adhesive 6".

The water-repellent film 7 is formed on surfaces of the nozzle plate 4-3 and the nozzle cover 5-2 to be bonded to each other.

A partial area in the water-repellent film 7 is removed by a secondary treatment to form the non-water-repellent surface in the nozzle plate 4-3. Thus, a base material of the nozzle plate 4-3 is exposed on the non-water-repellent surface.

Further, a partial area in the water-repellent film 7 is removed by a secondary treatment to form the non-water-repellent surface in the nozzle cover 5-2. Thus, a base material of the nozzle cover 5-2 is exposed on the non-water-repellent surface. The two non-water-repellent surfaces in the nozzle plate 4-3 and the nozzle cover 5-2 function as a first region 8*a* and a second region 8*b* onto which the adhesive 6 is applied.

In FIG. 7, the first region 8*a* is a region onto which the first adhesive 6-1 is applied, and the second region 8*b* is a region onto which the second adhesive 6-2 is applied, for example. Further, a third region 8*c* that separates the first adhesive 6-1 and the second adhesive 6-2 is formed on a surface of the nozzle cover 5-2. The third region 8*c* is a portion of the water-repellent film 7 serving as the water-repellent surface of the nozzle cover 5-2. The third region 8*c* is formed between the first region 8*a* and the second region 8*b* onto which the first adhesive 6-1 and the second adhesive 6-2 are applied. The third region 8*c* faces the nozzle plate 4-3.

In FIG. 7, the two non-water-repellent surfaces formed on the nozzle plate 4-3 and the nozzle cover 5-2 are regions onto which the water-repellent film 7 is not formed. In the following figures, the water-repellent surface and the non-water-repellent surface formed on the nozzle plate 4-3, the nozzle cover 5-2, and the like are illustrated in the same manner as in FIG. 7.

Further, a region onto which the water-repellent film 7 is formed is also referred to as the "water-repellent region", and a region onto which the non-water-repellent surface is formed is also referred to as the "non-water-repellent region".

Figure 8A:
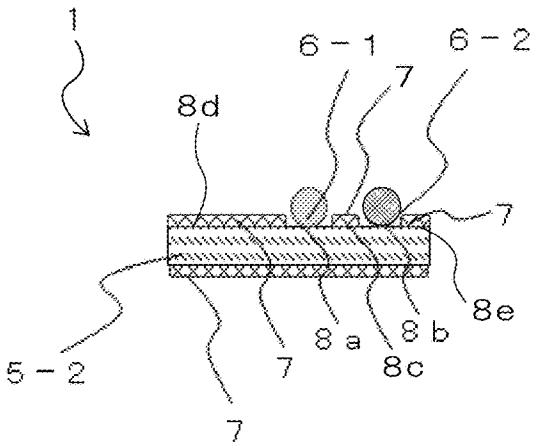
FIGS. 8A to 8D are enlarged cross-sectional views of a portion of the head 2 illustrating an example of a bonding process between the nozzle plate and the nozzle cover.
Figure 8B:
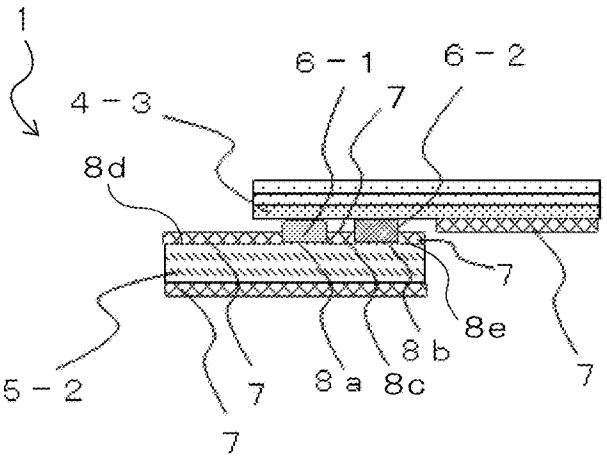
Figure 8C:
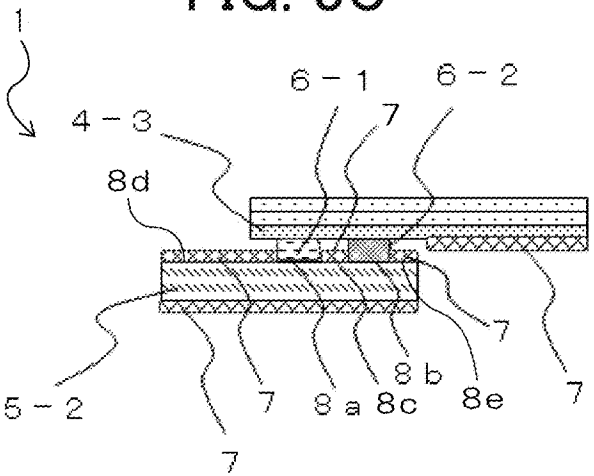
Figure 8D:
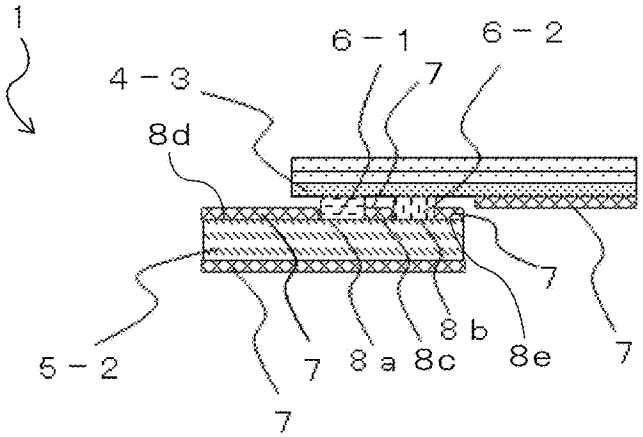

FIGS. 8A to 8D are enlarged cross-sectional views of a portion of the head 2 illustrating an example of a bonding process between the nozzle plate 4-3 and the nozzle cover 5-2. FIG. 8A illustrates an application process in an adhesive application process. FIG. 8B illustrates a pressing process in the adhesive application process. FIG. 8C illustrates an adhesive curing process in a room temperature environment. FIG. 8D illustrates an adhesive curing process in a high temperature environment.

In FIG. 8A, the first adhesive 6-1 is applied to the first region 8*a*, and the second adhesive 6-2 is applied to the second region 8*b*. The first region 8*a* and the second region 8*b* are the two non-water-repellent surfaces formed on the nozzle cover 5-2.

FIG. 8B illustrates the adhesive application process that applies both adhesives 6 (first adhesive 6-1 and second adhesive 6-2) at once, and then the nozzle plate 4-3 is pressed against the adhesives 6. The adhesives 6 (first adhesive 6-1 and second adhesive 6-2) pressed by the nozzle plate 4-3 are crushed and spread.

However, the adhesives 6 (first adhesive 6-1 and second adhesive 6-2) do not mix with each other during spreading by the third region 8*c* (water-repellent surface of the water-repellent film 7) formed between the first region 8*a* and the second region 8*b*. Thus, the bonding structure according to the present disclosure can appropriately apply the adhesives 6 on the non-water-repellent surfaces on the nozzle cover 5-2.

In FIG. 8C illustrating a subsequent adhesive curing process in a room temperature environment, the first adhesive 6-1 is cured, and a position between the nozzle plate 4-3 and the nozzle cover 5-2 is fixed.

In FIG. 8D illustrating the adhesive curing process in the next high temperature environment, the second adhesive 6-2 is cured, and a seal surface having liquid resistance is formed.

The third region 8*c* formed on the nozzle cover 5-2 prevents the two types of adhesives 6 (first adhesive 6-1 and second adhesive 6-2) from mixing with each other. The third region 8*c* is formed between the first region 8*a* onto which the first adhesive 6-1 is applied and the second region 8*b* onto which the second adhesive 6-2 is applied. Conversely, a portion of the nozzle plate 4-3 to be bonded to the nozzle cover 5-2 with the adhesives 6 (first adhesive 6-1 and second adhesive 6-2) is processed to have one non-water-repellent surface.

Thus, the adhesives 6 applied on the nozzle cover 5-2 with a dispenser or the like is thinly crushed when the two parts (nozzle cover 5-2 and the nozzle plate 4-3) are bonded. The dispenser is selected as the application means as described-above because a gap between the two parts (nozzle cover 5-2 and the nozzle plate 4-3) is several tens of microns.

Thus, the two adhesives 6 are not mixed on a bonding surface of the nozzle plate 4-3. A direction along the bonding surface (bonding surface direction) is indicated by arrow "BSD" in FIG. 7. Thus, a water-repellent region does not have to be formed in a portion of the bonding surface of the nozzle plate 4-3 to be bonded to the nozzle cover 5-2 with the adhesives 6.

Further, the third region 8*c* may be formed on both of bonding surfaces of the two parts (nozzle cover 5-2 and the nozzle plate 4-3, for example) according to the adhesive 6 used in a bonding structure and a structure of each part, etc.

In FIG. 7, the water-repellent film 7 existed outside the first region 8*a* and the second region 8*b* can prevent the adhesives 6 applied on the first region 8*a* and the second region 8*b* from spreading outside the first region 8*a* and the second region 8*b*. A region on an opposite side of the third region 8*c* across the first region 8*a* in the bonding surface direction BSD is referred to as an "outer first region 8*d*". A region on an opposite side of the third region 8*c* across the second region 8*b* in the bonding surface direction BSD is referred to as an "inner second region 8*e*". The outer first region 8*d* is arranged left side of the first region 8*a* in FIG. 7. The inner second region 8*e* is arranged right side (opening side) of the second region 8*b* in FIG. 7. Specifically, the outer first region 8*d* is arranged outside the first region 8*a* (left side of the first region 8*a* in FIG. 7) that is opposite to the third region 8*c* across the first region 8*a* in the bonding surface direction BSD. Further, the inner second region 8*e* is arranged outside the second region 8*b* (right side of the second region 8*b* in FIG. 7) that is arranged on an opposite side of the third region 8*c* across the second region 8*b* in the bonding surface direction BSD.

Since the ink enters from a surface of the nozzle plate 4-3 exposed from the nozzle cover 5-2 (from right side in FIG. 7), the thermosetting second adhesive 6-2 is formed on an opening side (second region 8*b*) of the nozzle cover 5-2. The opening side from which the ink enters is a right side in FIG. 7 between the second adhesive 6-2 and the water-repellent film 7 on the nozzle plate 4-3. The second adhesive 6-2 can prevent the ink from entering into an interior of the head 2 from the interface between the nozzle plate 4-3 and the nozzle cover 5-2.

Therefore, the bonding structure according to the first embodiment has liquid resistance in an interface between the nozzle plate 4-3 and the nozzle cover 5-2 so that ink does not enter the interface between the nozzle plate 4-3 and the nozzle cover 5-2. Further, using adhesives described in the first embodiment can highly accurately position and fix the parts of the head 2.

Further, the second adhesive 6-2 having liquid resistance is preferably applied to a position closer to the nozzle 11 of the nozzle plate 4-3 than the first adhesive 6-1 having no liquid resistance to prevent ink from entering a bonding portion such as the interface between the nozzle plate 4-3 and the nozzle cover 5-2.

Second Embodiment

In a second embodiment of the present disclosure, a bonding structure includes a first part as a nozzle cover and a second part as an actuator substrate.

Figure 9:
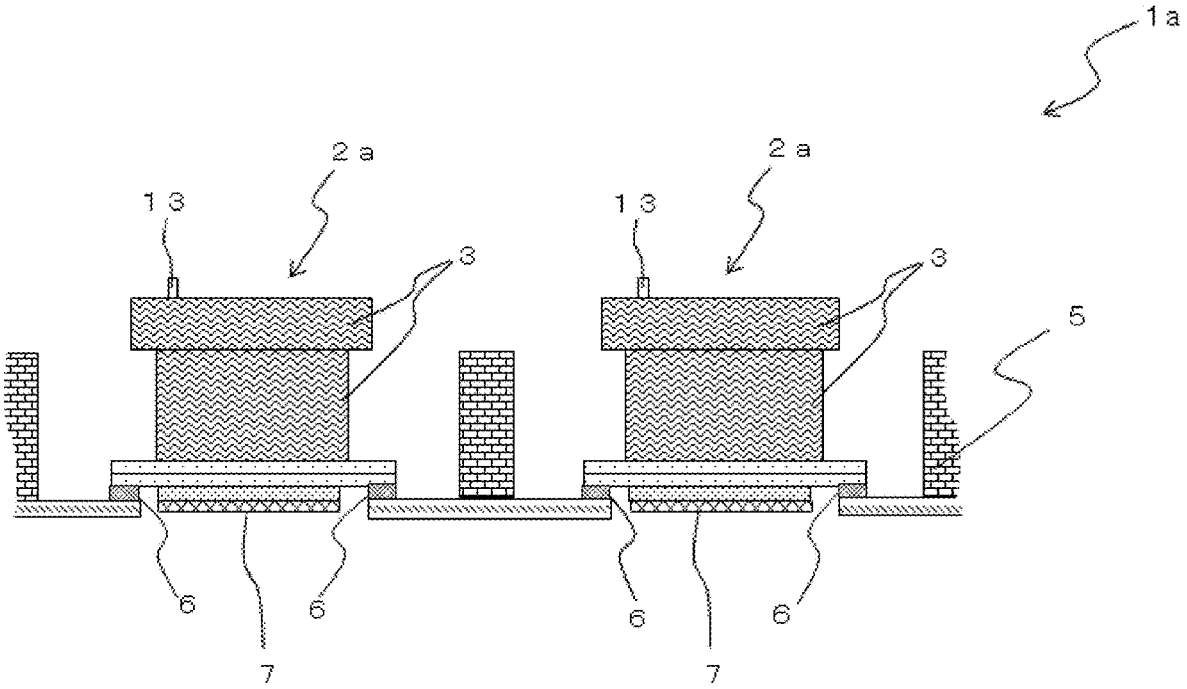
FIG. 9 is a schematic cross-sectional view of an example of a head module that uses a bonding structure according to a second embodiment of the present disclosure.

FIG. 9 is a schematic cross-sectional view of an example of a head module 1*a* that uses the bonding structure according to the second embodiment of the present disclosure.

Figure 10:
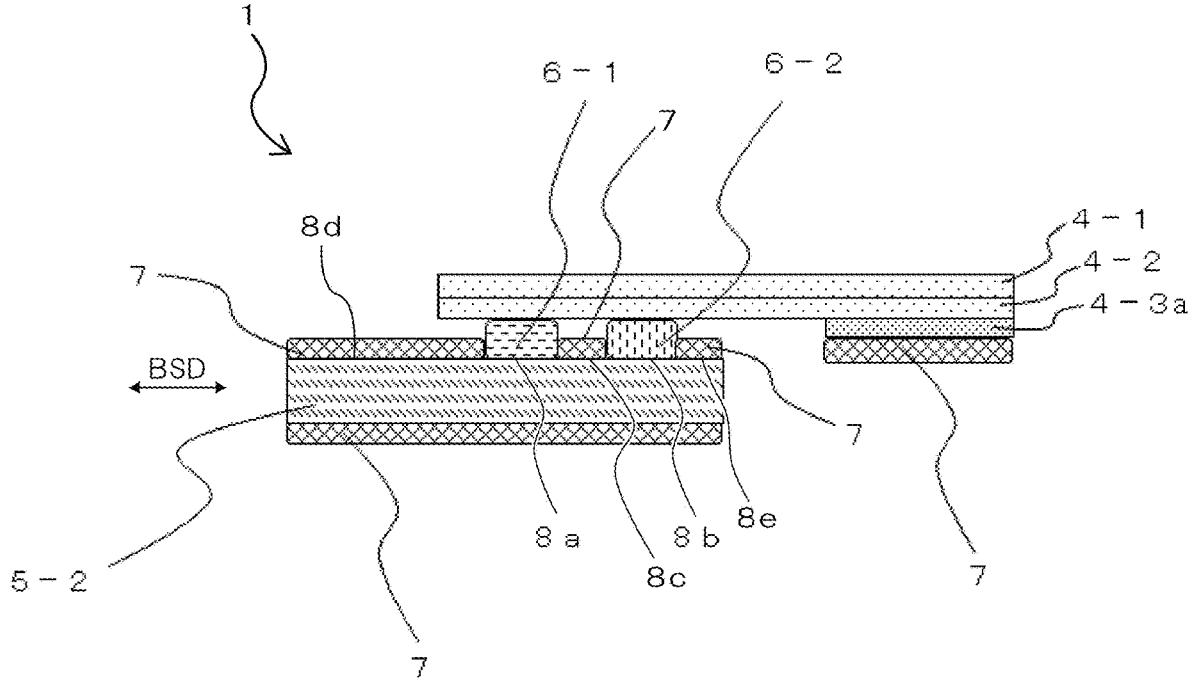
FIG. 10 is an enlarged schematic cross-sectional view of an example of a bonding portion between the head and the base unit of the head module illustrated in FIG. 9.

FIG. 10 is an enlarged schematic cross-sectional view of an example of a bonding portion between the head 2*a* and the base unit 5 of the head module 1*a* illustrated in FIG. 9.

In FIG. 9, the head module 1*a* includes the head 2*a* and a base unit 5 bonded with an adhesive 6.

The head 2*a* in FIG. 9 is the same as the head 2 in FIG. 4 except that a width of a nozzle plate 4-3*a* in FIG. 10 is smaller than a width of the nozzle plate 4-3 in FIG. 7. Thus, an outer shape of the nozzle plate 4-3*a* according to the second embodiment is smaller than an outer shape of the actuator substrate 4-2.

The base unit 5 in FIG. 9 is the same as the base unit 5 in FIG. 6.

In the second embodiment, the base unit 5 and the head 2*a* are fixed with an adhesive 6 that bonds the nozzle cover 5-2 and the actuator substrate 4-2 exposed from the nozzle plate 4-3*a*, the width of which is reduced.

A width of the nozzle plate 4-3*a* can be reduced because the nozzle 11 is arranged at a center of the part. Further, the nozzle plate 4-3*a* is formed by dividing a silicon wafer as a base material. It is preferable to increase a number of parts (nozzle plates 4-3*a*) taken from the silicon wafer by reducing the width of the nozzle plate 4-3*a* to reduce a cost of the nozzle plate 4-3*a*. An aspect of bonding the nozzle cover 5-2 and the actuator substrate 4-2 is described below in the second embodiment.

An entire surface of the actuator substrate 4-2 is a non-water-repellent surface.

Further, partial two regions in the water-repellent film 7 is removed by a secondary treatment to form the non-water-repellent surfaces in the nozzle cover 5-2 as in the first embodiment illustrated in FIG. 7. The two regions of the non-water-repellent surfaces formed on the nozzle cover 5-2 function as the first region 8*a* to which the first adhesive 6-1 is applied and the second region 8*b* to which the second adhesive 6-2 is applied. A surface on which the water-repellent film 7 is formed between the first region 8*a* and the second region 8*b* functions as the third region 8*c*. The first adhesive 6-1 is applied on the first region 8*a*, and the second adhesive 6-2 is applied on the second region 8*b*.

For example, the first adhesive 6-1 can be cured in a room temperature environment. The second adhesive 6-2 is cured only in a high temperature environment and has liquid resistance. That is, the first adhesive 6-1 is an adhesive curable in the room-temperature, and the second adhesive 6-2 is a thermosetting adhesive.

The third region 8*c* formed on the nozzle cover 5-2 prevents the two types of adhesives 6 (first adhesive 6-1 and second adhesive 6-2) from mixing with each other. The third region 8*c* is formed between the first region 8*a* onto which the first adhesive 6-1 is applied and the second region 8*b* onto which the second adhesive 6-2 is applied. Conversely, the actuator substrate 4-2 is not subjected to water-repellent treatment.

However, the adhesives 6 (first adhesive 6-1 and second adhesive 6-2) applied on the nozzle cover 5-2 with a dispenser or the like is thinly crushed when the two parts (nozzle cover 5-2 and the nozzle plate 4-3*a*) are bonded. The dispenser is selected as the application means as described-above because a gap between the two parts (nozzle cover 5-2 and the nozzle plate 4-3) is several tens of microns.

Thus, the two adhesives 6 (first adhesive 6-1 and second adhesive 6-2) are not mixed on the bonding surface of the actuator substrate 4-2. Thus, a water-repellent region is not necessary formed in a portion of the bonding surface of the actuator substrate 4-2 to be bonded to the nozzle cover 5-2 with the adhesives 6.

Therefore, the bonding structure according to the second embodiment has liquid resistance in an interface between the actuator substrate 4-2 and the nozzle cover 5-2 so that ink does not enter the interface between the actuator substrate 4-2 and the nozzle cover 5-2. Further, using adhesives 6 as described in the second embodiment can highly accurately position and fix the parts of the head 2*a*.

In FIG. 10, the water-repellent film 7 existed outside the first region 8*a* and the second region 8*b* can prevent the applied adhesive 6 from spreading outside the first region 8*a* and the second region 8*b*.

Third Embodiment

Figure 11:
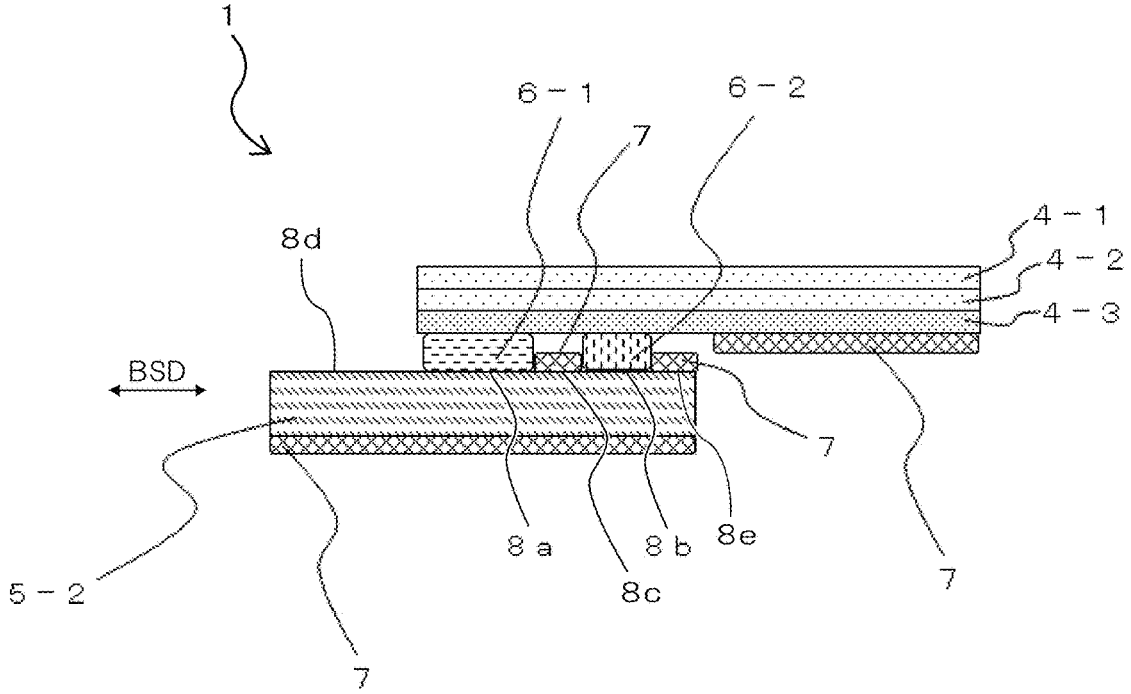
FIG. 11 is a schematic cross-sectional view of an example of a bonding portion between a nozzle cover and a nozzle plate of a head module that uses a bonding structure according to a third embodiment of the present disclosure.
Figure 12:
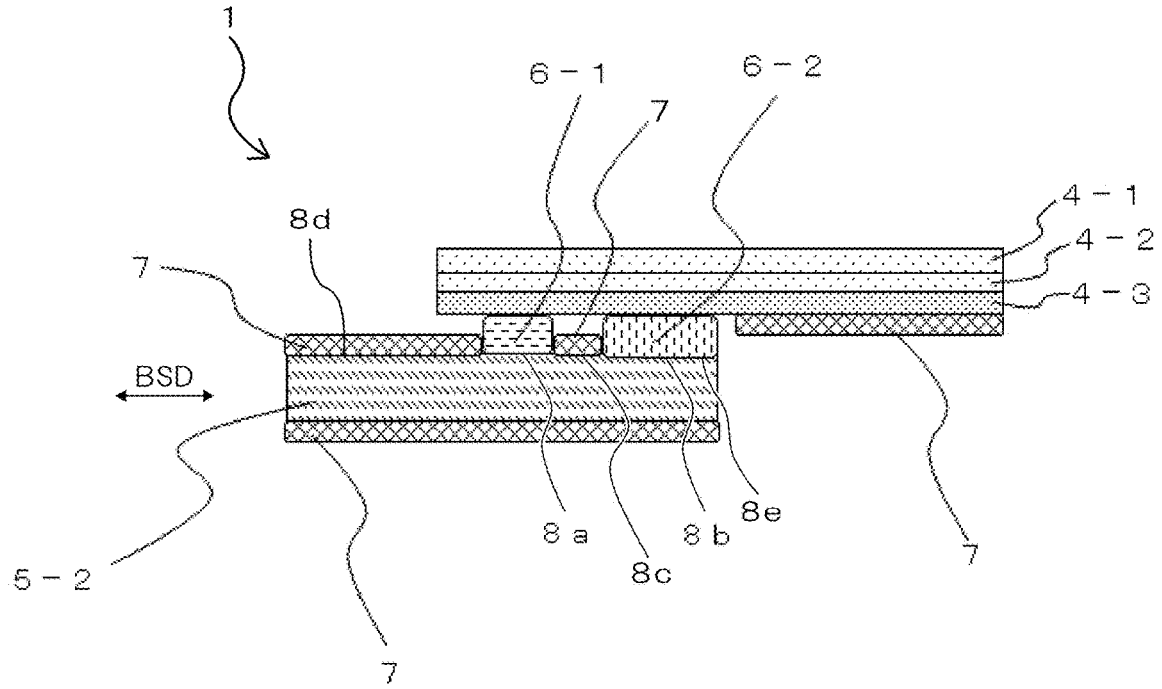
FIG. 12 is a schematic cross-sectional view of another example of a bonding portion between a nozzle cover and a nozzle plate of the head module that uses the bonding structure according to the third embodiment of the present disclosure.
Figure 13:
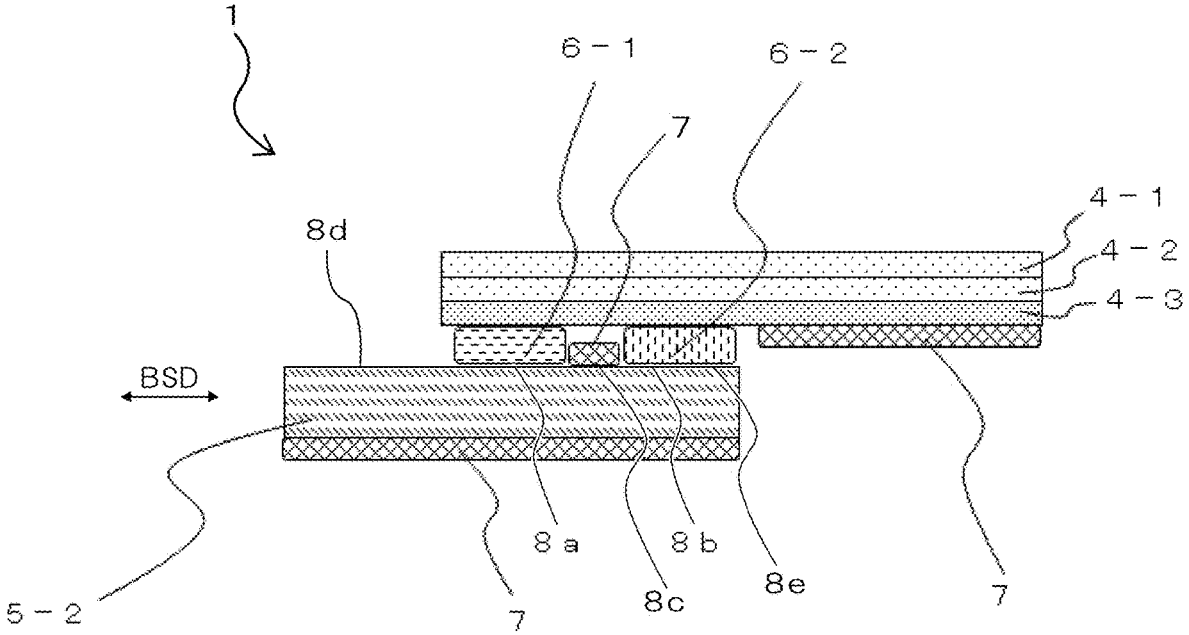
FIG. 13 is a schematic cross-sectional view of still another example of a bonding portion between a nozzle cover and a nozzle plate of the head module that uses the bonding structure according to the third embodiment of the present disclosure.

A third embodiment describes an aspect in which a non-water-repellent surface is formed in an area outside the first region 8*a* and the second region 8*b*. As illustrated in FIGS. 11 to 13, a region outside the first region 8*a* and the second region 8*b* is the same as the region outside the first region 8*a* and the second region 8*b* in the first embodiment in FIG. 7. The outer first region 8*d* is arranged outside the first region 8*a* (left side of the first region 8*a*) opposite to the third region 8*c* across the first region 8*a* in bonding surface direction BDF in FIG. 11. Further, the inner second region 8*e* is arranged outside the second region 8*b* (right side of the second region 8*b*) opposite to the third region 8*c* across the second region 8*b* in the bonding surface direction BSD in FIG. 11.

FIGS. 11 to 13 are enlarged schematic cross-sectional views of an example of a bonding portion between a nozzle plate of a head module and a nozzle cover that uses a bonding structure according to the third embodiment of the present disclosure. In FIGS. 11 to 13, the configuration of the head module 1 of FIG. 4 is used, a head 2 is the same as the head 2 of FIG. 5, and a base unit 5 is the same as the base unit 5 of FIG. 6.

The water-repellent film 7 in the first region 8*a* and the outer first region 8*d* outside (left side) of the third region 8*c* is removed in FIG. 11. In FIG. 11, the outer first region 8*d* from which the water-repellent film 7 is removed is disposed outside (left side) of the first adhesive 6-1. Thus, the first adhesive 6-1 is applied and spread on the first region 8*a* and the outer first region 8*d*. The first region 8*a* and the outer first region 8*d* are one continuous region in FIG. 11.

The water-repellent film 7 in the second region 8*b* and the inner second region 8*e* outside (right side) of the third region 8*c* and the second region 8*b* is removed in FIG. 12. In FIG. 11, the inner second region 8*e* from which the water-repellent film 7 is removed is disposed outside (right side) of the second adhesive 6-2. Thus, the second adhesive 6-2 is applied and spread on the second region 8*b* and the inner second region 8*e*. The second region 8*b* and the inner second region 8*e* are one continuous region in FIG. 12.

The water-repellent film 7 exists only in the third region 8*c*, and the water-repellent film 7 is removed from regions other than the third region 8*c* on an inner surface (upper surface in FIG. 13) of the nozzle cover 5-2 along the bonding surface direction BSD in FIG. 13. Thus, the water-repellent film 7 is removed from the first region 8*a*, the outer first region 8*d*, the second region 8*b*, and the inner second region 8*e* in FIG. 13. Thus, the first adhesive 6-1 is applied and spread on the first region 8*a* and a part of the outer first region 8*d*. Further, the second adhesive 6-2 is applied and spread on the second region 8*b* and a part of the inner second region 8*e*.

When a dispenser is selected as an application method to apply the adhesive 6 on the nozzle cover 5-2, an amount of adhesive applied on the nozzle cover 5-2 by the dispenser becomes relatively larger than an amount of adhesive applied by other application methods.

However, it is desirable to apply a minute amount of the adhesive 6 on a minute region from a viewpoint of layout of the head 2. It is difficult to adjust an amount of adhesive 6 applied on the nozzle cover 5-2 by the dispenser because the amount of adhesive 6 applied by the dispenser is larger than the amount of adhesive 6 applied by other methods. Thus, behavior of the adhesive 6 varies depending on an inherent viscosity and contact angle of the adhesive 6.

Thus, a large amount of adhesive 6 may be applied to a minute region on the nozzle cover 5-2 because it is difficult to appropriately manage an amount of each adhesives 6 applied on the nozzle cover 5-2. Thus, bonding failure may occur due to excessive elasticity of the adhesive 6 because of the large amount of adhesive 6 applied on the minute region on the nozzle cover 5-2.

Therefore, the water-repellent film 7 outside the adhesive 6 is partially removed to form an escape route of the adhesive 6 in the third embodiment. Thus, the bonding structure according to the third embodiment can optimize an amount of each adhesives 6 spread on the nozzle cover 5-2, behaviors of which vary according to an inherent viscosity and contact angle of the adhesives 6.

Further, a part or all of the water-repellent film 7 existed in a region other than an adhesive application region (for example, the first region 8*a* or the second region 8*b*) is removed. Thus, it becomes easier to control an amount of adhesive 6 applied on the nozzle cover 5-2 because the adhesive 6 spreads on the non-water-repellent surface (first region 8*a* and second region 8*b*, for example) even if the amount of adhesive 6 applied on the nozzle cover 5-2 increases.

The configurations of the head module 1 illustrated in FIGS. 4 to 6 are used to describe the third embodiment of the present disclosure. However, the configurations of the head module 1 illustrated in FIGS. 9 to 10 may also be used to describe the third embodiment of the present disclosure.

Fourth Embodiment

The bonding structure according to a fourth embodiment of the present disclosure includes at least one of the first part and the second part having a stepped shape. The stepped shape includes two or more stepped surfaces having different distances from other bonding surfaces. The bonding surface (also referred to as "opposing surface") is a surface on which the first part and the second part face each other, and is a surface on which the adhesive is applied to bond the two parts (the first part and the second part).

Figure 14:
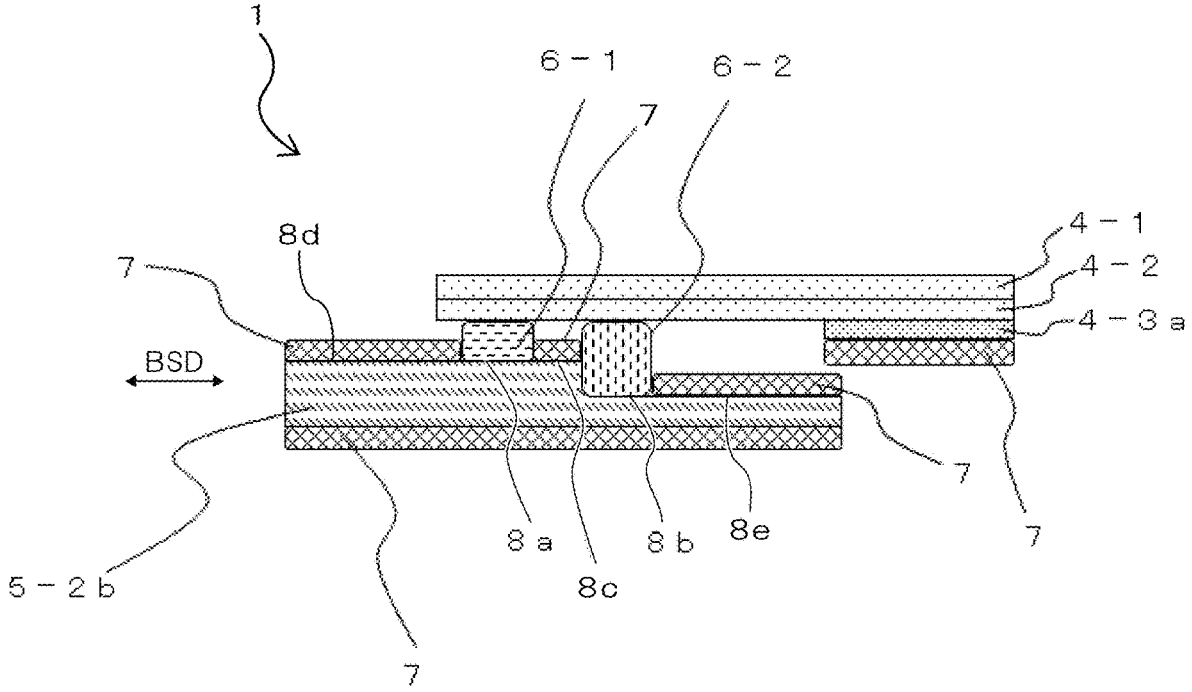
FIG. 14 is an enlarged schematic cross-sectional views of an example of a bonding portion between a nozzle cover and an actuator substrate of a head module that uses a bonding structure according to a fourth embodiment of the present disclosure.

FIG. 14 is an enlarged schematic cross-sectional view of an example of a bonding portion between an actuator substrate 4-2 of a head module 1 that uses a bonding structure according to the fourth embodiment of the present disclosure and a nozzle cover 5-2*b*. A configuration of the head 2 in FIG. 14 is the same as a configuration of the head 2 in FIG. 5 except that a width of the nozzle plate 4-3*a* in FIG. 14 is smaller than a width of the nozzle plate 4-3 in FIG. 5. A configuration of the base unit 5 in FIG. 14 is the same as a configuration of the base unit 5 in FIG. 6 except that the nozzle cover 5-2*b* has a stepped shape as described below.

The head module 1 in the fourth embodiment includes the nozzle cover 5-2*b* having a stepped shape that includes two or more stepped surfaces having different distances from the bonding surface (lower surface in FIG. 14) of the actuator substrate 4-2. The nozzle cover 5-2*b* includes a first region 8*a* onto which the first adhesive 6-1 is applied and a second region 8*b* onto which the second adhesive 6-2 is applied. The first region 8*a* and the second region 8*b* are arranged at different stepped surfaces, the distance from the bonding surface of the actuator substrate 4-2 of which differ between the stepped surface of the first region 8*a* and the stepped surface of the second region 8*b*.

In the fourth embodiment, the water-repellent film 7 is formed on a third region 8*c* between the first region 8*a* and the second region 8*b*, an inner second region 8*e* on the nozzle plate 4-3*a* side of the second region 8*b*, and an outer first region 8*d* disposed opposite to the nozzle plate 4-3*a* (third region 8*c* side) side across the first region 8*a* along the bonding surface direction BSD.

Further, as illustrated in FIG. 14, the nozzle cover 5-2*b* may have a length enough to overlap (cover) an end portion of the nozzle plate 4-3*a* when viewed from a discharge surface side (from lower side in FIG. 14) on which the liquid is discharged from the nozzle 11. Thus, the nozzle plate 4-3*a* prevents a blade from contact with an end part of the nozzle plate 4-3*a* made of a Si single crystal material when the ink attached to the nozzles 11 in the nozzle plate 4-3*a* is wiped by the blade or the like. A hardness of the blade generally made of rubber is smaller than a hardness of the nozzle plate 4-3*a* made of Si single crystal material. Thus, the bonding structure in fourth embodiment can prevent damage to the blade.

According to the head module 1 according to the fourth embodiment of the present disclosure, the nozzle cover 5-2*b* includes a stepped portion (stepped surface) on a bonding surface to be bonded to the actuator substrate 4-2. Thus, the bonding structure according to the fourth embodiment can optimize an amount of each of the first adhesive 6-1 and the second adhesive 6-2 spread on the nozzle cover 5-2*b*, behaviors of which vary according to an inherent viscosity and contact angle of the first adhesive 6-1 and the second adhesive 6-2.

The configurations of the head module 1 illustrated in FIGS. 9 to 10 are used to describe the fourth embodiment of the present disclosure. However, the configurations of the head module 1 illustrated in FIGS. 4 to 6 may also be used to the fourth embodiment of the present disclosure.

Fifth Embodiment

The head module 1 according to fifth embodiment of the present disclosure includes a bonding structure having a stepped shape on one bonding surface as similarly with the head module 1 according to fourth embodiment. A configuration of the head module 200 including one head bonded to one nozzle cover is described below.

Figure 15:
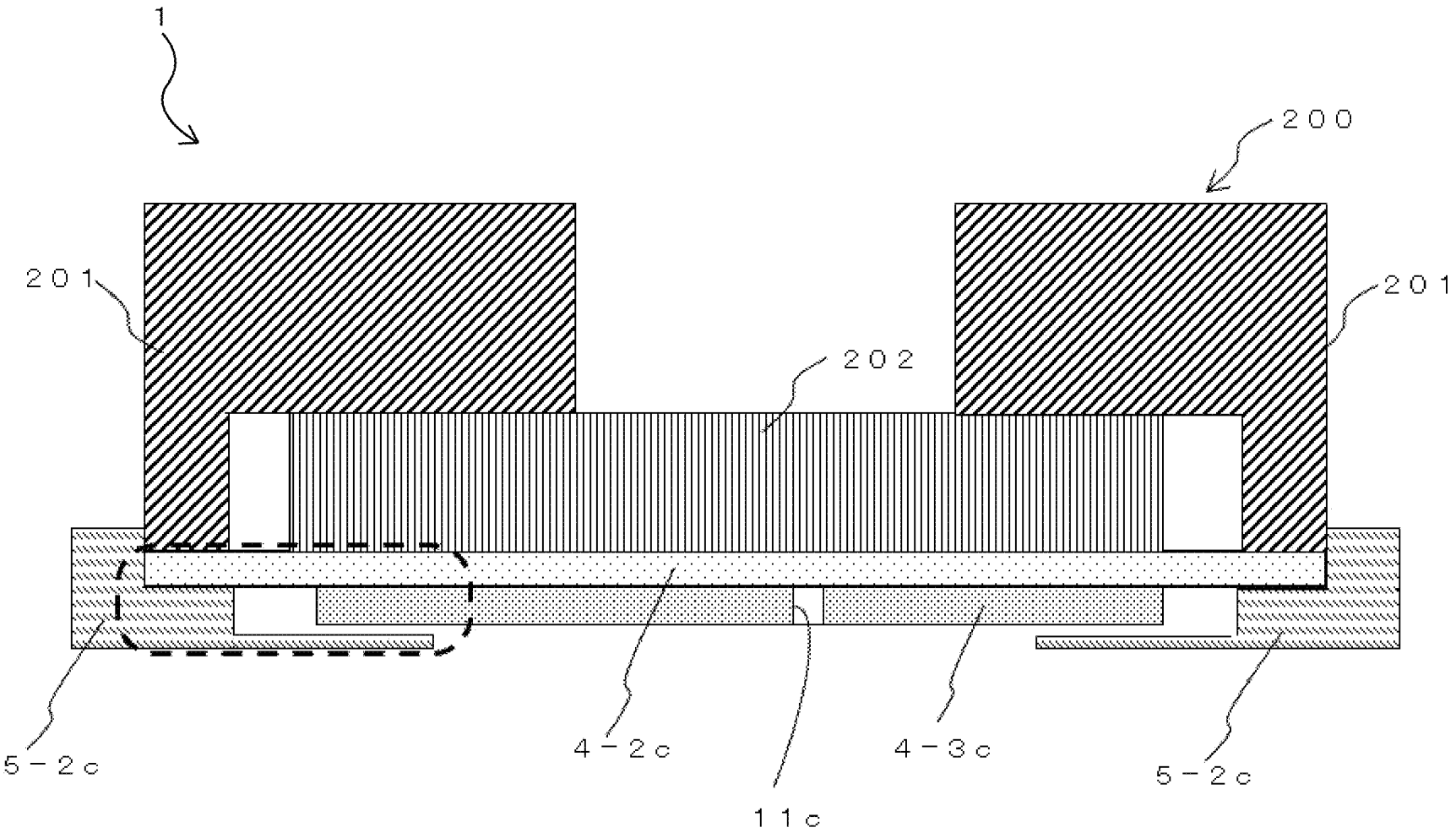
FIG. 15 is a schematic cross-sectional view of an example of a head module that uses a bonding structure according to a fifth embodiment of the present disclosure.

FIG. 15 is a schematic cross-sectional view of an example of a head module 1 that uses the bonding structure according to the fifth embodiment of the present disclosure.

The head module 200 includes at least an actuator substrate 4-2*c*, a nozzle plate 4-3*c*, a nozzle cover 5-2*c*, a frame 201 (housing), and a holding substrate 202 (subframe).

Figure 16:
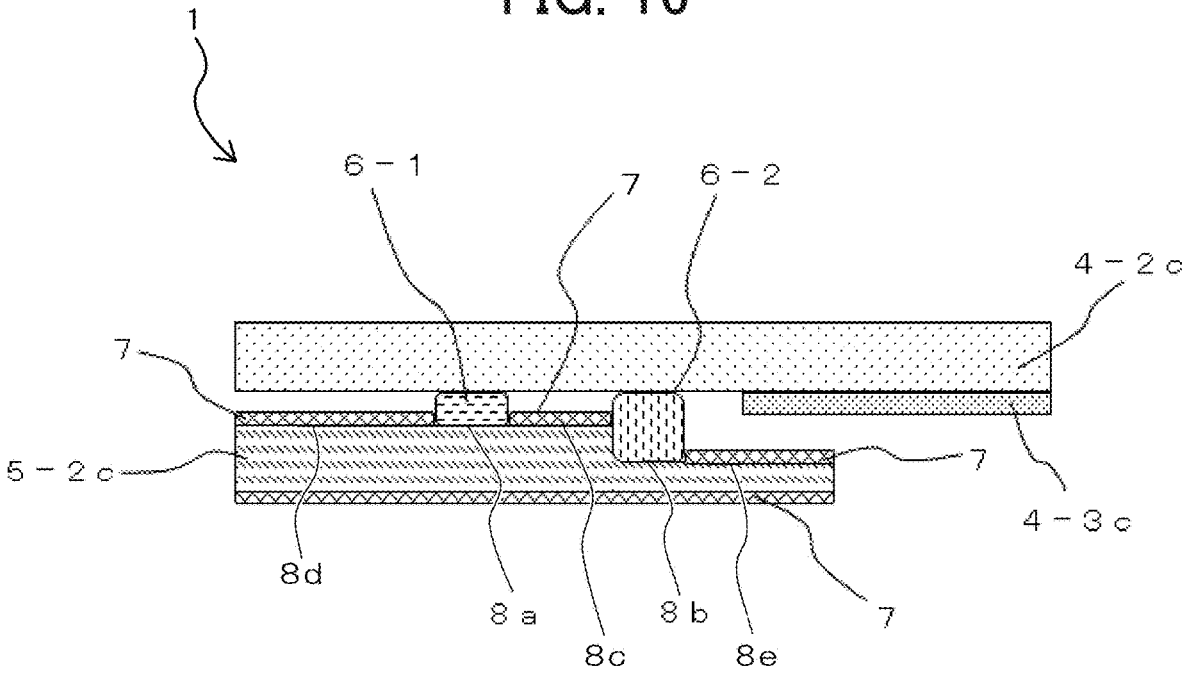
FIG. 16 is an enlarged schematic cross-sectional view of an example of a bonding portion between the head and the base unit of the head module illustrated in FIG. 15.

FIG. 16 is an enlarged schematic cross-sectional views of an example of a bonding portion between an actuator substrate 4-2*c* of a head module 1 illustrated in FIG. 15 and a nozzle cover 5-2*c*. FIG. 16 illustrates a main portion of the bonding structure indicated by a broken line on a left side of FIG. 15.

The head module 1 in the fifth embodiment includes the nozzle cover 5-2*c* having a stepped shape that includes two or more stepped surfaces having different distances from the bonding surface (lower surface in FIG. 14) of the actuator substrate 4-2*c*. The nozzle cover 5-2*c* includes a first region 8*a* onto which the first adhesive 6-1 is applied and a second region 8*b* onto which the second adhesive 6-2 is applied. The first region 8*a* and the second region 8*b* are arranged at different stepped surfaces, the distance from the bonding surface of the actuator substrate 4-2*c* of which differ between the stepped surface of the first region 8*a* and the stepped surface of the second region 8*b*.

Further, as illustrated in FIG. 16, the nozzle cover 5-2*c* may have a length enough to overlap (cover) a peripheral end portion of the nozzle plate 4-3*c* when viewed from the discharge surface side (from lower side in FIG. 16) on which the liquid is discharged from the nozzle 11 because of the same reason as described in the fourth embodiment in FIG. 14.

The configuration in FIG. 16 can provide the same effects as the effects obtained by the fourth embodiment in FIG. 14.

Sixth Embodiment

In a sixth embodiment, an example of a bonding surface of a nozzle cover configured to bonding a plurality of head modules is described below.

Figure 17:
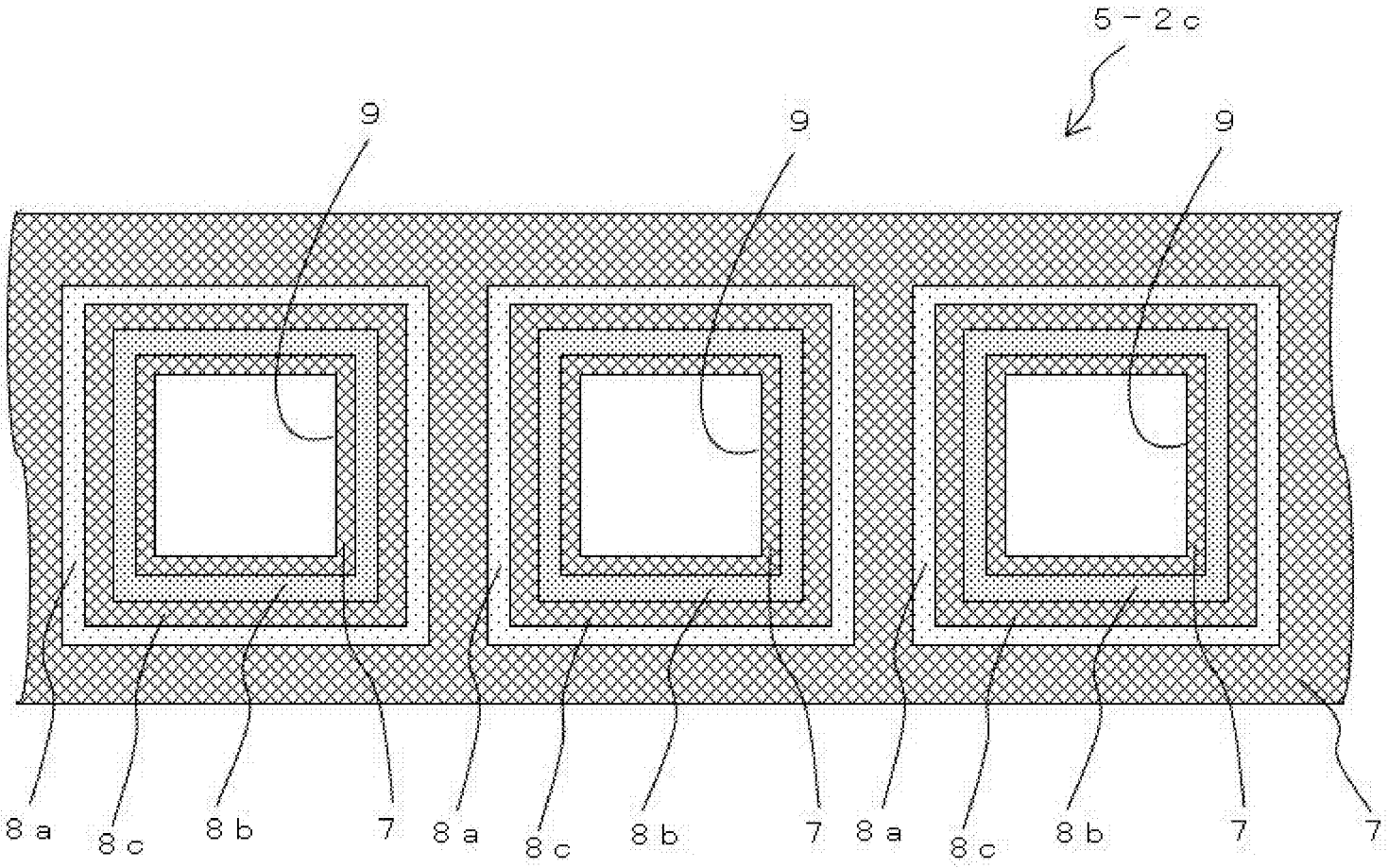
FIG. 17 is a plan view of a surface opposite to a discharge surface of a nozzle cover illustrated in FIG. 16.

FIG. 17 is a plan view of a surface (that is, a bonding surface) opposite to the discharge surface of the nozzle cover illustrated in FIG. 16. FIG. 17 illustrates an example in which the nozzle cover of the bonding structure illustrated in FIG. 16 is configured to bond a plurality of head modules 200.

FIG. 16 illustrates a state in which a third region 8*c* as a water-repellent region and a first region 8*a* and a second region 8*b* as non-water-repellent regions are formed on the nozzle cover 5-2*c*.

In FIG. 16, the first region 8*a* and the second region 8*b* are regions from which the water-repellent film 7 formed on the nozzle cover 5-2*c* is partially removed to form a non-water-repellent surface, which is an application region on which the first adhesive 6-1 and the second adhesive 6-2 are applied. For example, the first adhesive 6-1 is applied to the first region 8*a*, and the second adhesive 6-2 is applied to the second region 8*b* in FIG. 16.

In FIG. 17, the third region 8*c* includes a water-repellent surface (a surface of the water-repellent film 7) that functions as the water-repellent film 7 that separates the first region 8*a* and the second region 8*b*. Although the third region 8*c* functions as the water-repellent film 7, a reference numeral of the third region 8*c* is different from reference numerals of other water-repellent films 7.

The nozzle cover 5-2*c* includes nozzle exposure holes 9 to expose the nozzles 11*c*. The nozzle exposure holes 9 are openings to expose the nozzle 11*c* formed in the nozzle plate 4-3*c* when the nozzle cover 5-2*c* and the actuator substrate 4-2*c* are bonded.

As illustrated in FIG. 17, the nozzle cover 5-2*c* includes the first regions 8*a* and the second regions 8*b* as non-water-repellent regions that surround the nozzle exposure holes 9.

FIG. 17 illustrates three sets of the first regions 8*a*, the second regions 8*b*, and third regions 8*c* formed to surround the nozzle exposure hole 9 as an example. The nozzle cover 5-2*c* includes nozzle exposure holes 9 corresponding to a number of head modules 200.

[Variations]

The heads 2 (liquid discharge heads) using the bonding structures having following characteristics are described in each of the embodiments of the present disclosure as described above.

A bonding structure includes a first part and a second part bonded with each other. A bonding surface at which the first part and the second part faces with (opposed to) each other are bonded with a first adhesive and a second adhesive, a type of which is different from a type of the first adhesive.

The bonding structure includes a third region having a water-repellency higher than a water repellency of each of the first region and the second region. The third region is formed between the first region and the second region on at least one of the bonding surface (opposed surface) of the first part and the bonding surface (opposed surface) of the second part. The first adhesive is applied on the first region, and the second adhesive is applied on the second region. The first region and the second region are partitioned by the third region sandwiched by the first region and the second region. Further, the bonding structure may further have the following characteristics.

For example, the bonding structure may include a region having high water-repellency in each of outer regions of the first region and the second region. Thus, the region having high water-repellency can prevent the adhesive applied on the first region and the second region to spread outside the first region and the second region.

The bonded structure may include a region having low water-repellency in each of outer regions of the first region and the second region, for example. Further, the bonding structure may include a stepped shape having two or more surfaces on at least one of the first part and the second part. Further, a first adhesive and a second adhesive may be applied to the two or more surfaces of the stepped shape of the bonding structure. Thus, the bonding structure according to the present disclosure can control an amount of adhesive spread on the nozzle cover, behaviors of which varies according to a characteristic of the adhesive.

In each of the above-described embodiments, an example in which the bonding structure is applied to a head module has been described. However, the bonding structure in the present disclosure is not limited to the above-described embodiments. Two different types adhesives may be used for other bonding structures to bond two parts, for example.

For example, the present disclosure may also be applied to a liquid discharge apparatus including a liquid discharge device including a plurality of liquid discharge heads (simply referred to as heads). The liquid discharge device includes, for example, a plurality of heads (liquid discharge heads), a base plate to which the plurality of heads is attached, and a nozzle cover in which a plurality of openings to expose each nozzle surfaces of the plurality of heads. In the above-described configuration, the first part of the bonding structure is a nozzle cover, and the second part of the bonding structure is each of actuator substrates of the heads or each nozzle plates of the heads.

The third region 8*c* described above may be formed to separate the first adhesive 6-1 and the second adhesive 6-2.

The head module 1 in FIG. 4 and the head module 1*a* in FIG. 9 are examples of the head module. The head module 1 in FIG. 4 includes the heads 2 and the base unit 5 in which the heads 2 are arrayed. The head module 1*a* in FIG. 9 includes the heads 2*a* and the base unit 5 in which the heads 2*a* are arrayed.

The head module includes at least one head and a cover bonded to at least one head with adhesive.

The head 2 is a part that configures a liquid discharge head, and the structure of the head 2 illustrated in FIG. 5 is one example.

Figure 18:
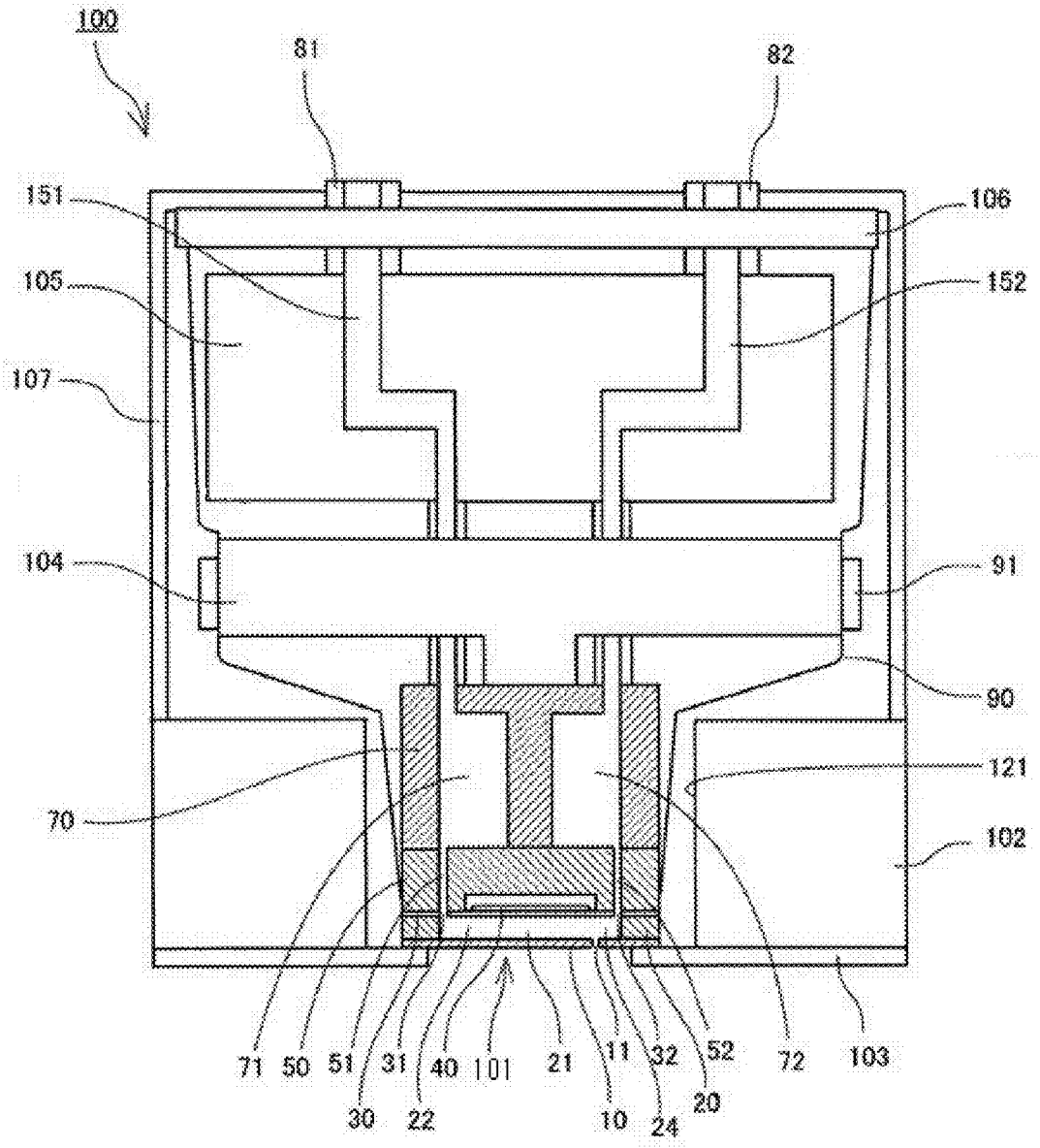
FIG. 18 is a cross-sectional view of a portion of a head module according to an embodiment of the present disclosure in a transverse direction of the head.
Figure 19:
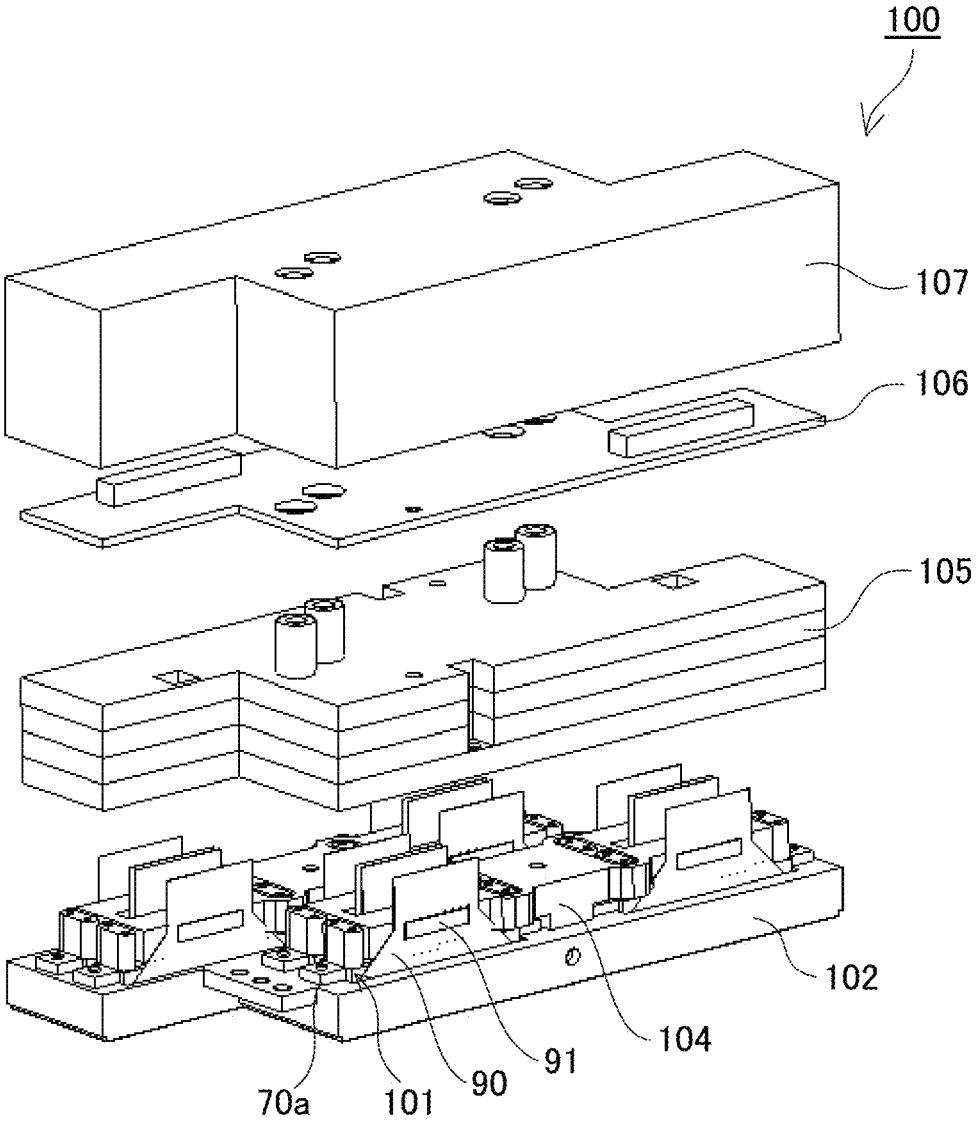
FIG. 19 is an exploded perspective view of the head module illustrated in FIG. 18.
Figure 20:
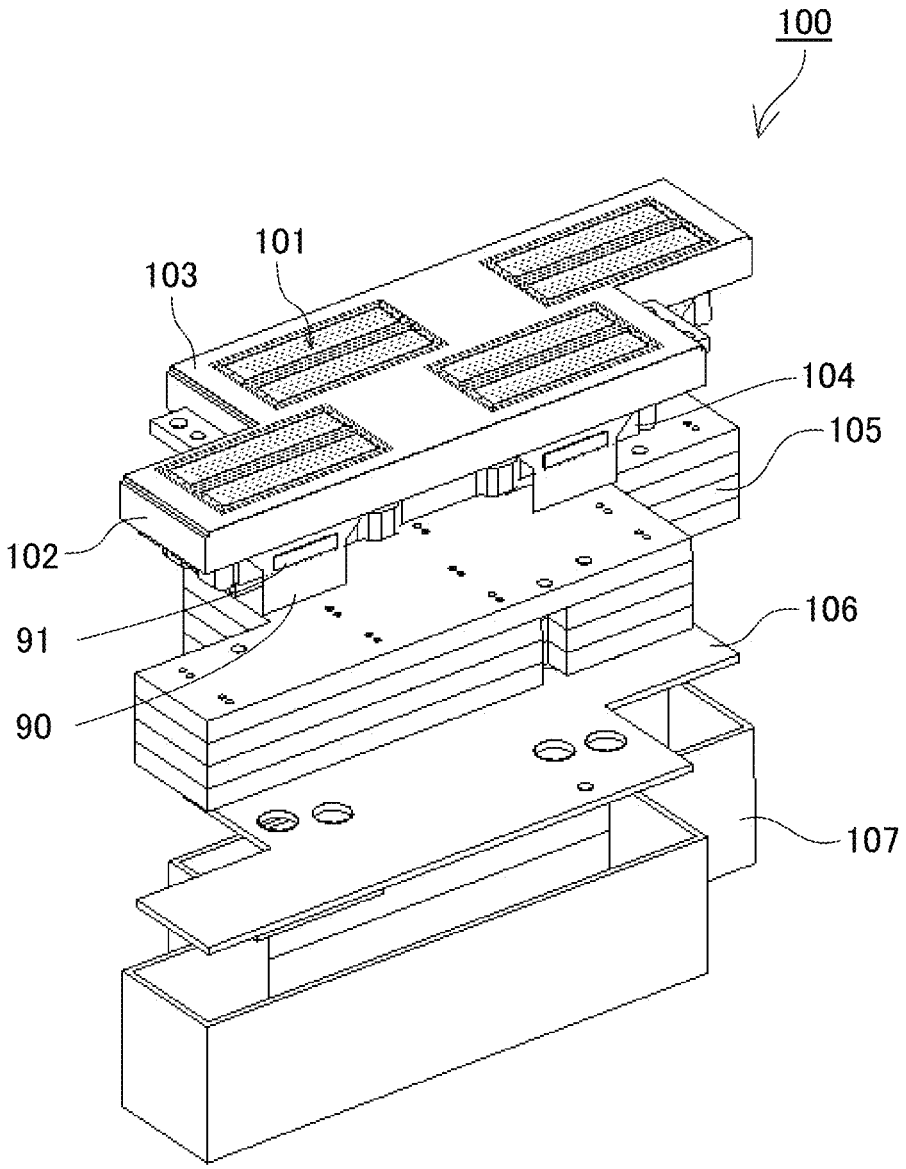
FIG. 20 is an exploded perspective view of the head module viewed from a nozzle surface side of the head module illustrated in FIG. 18.
Figure 21:
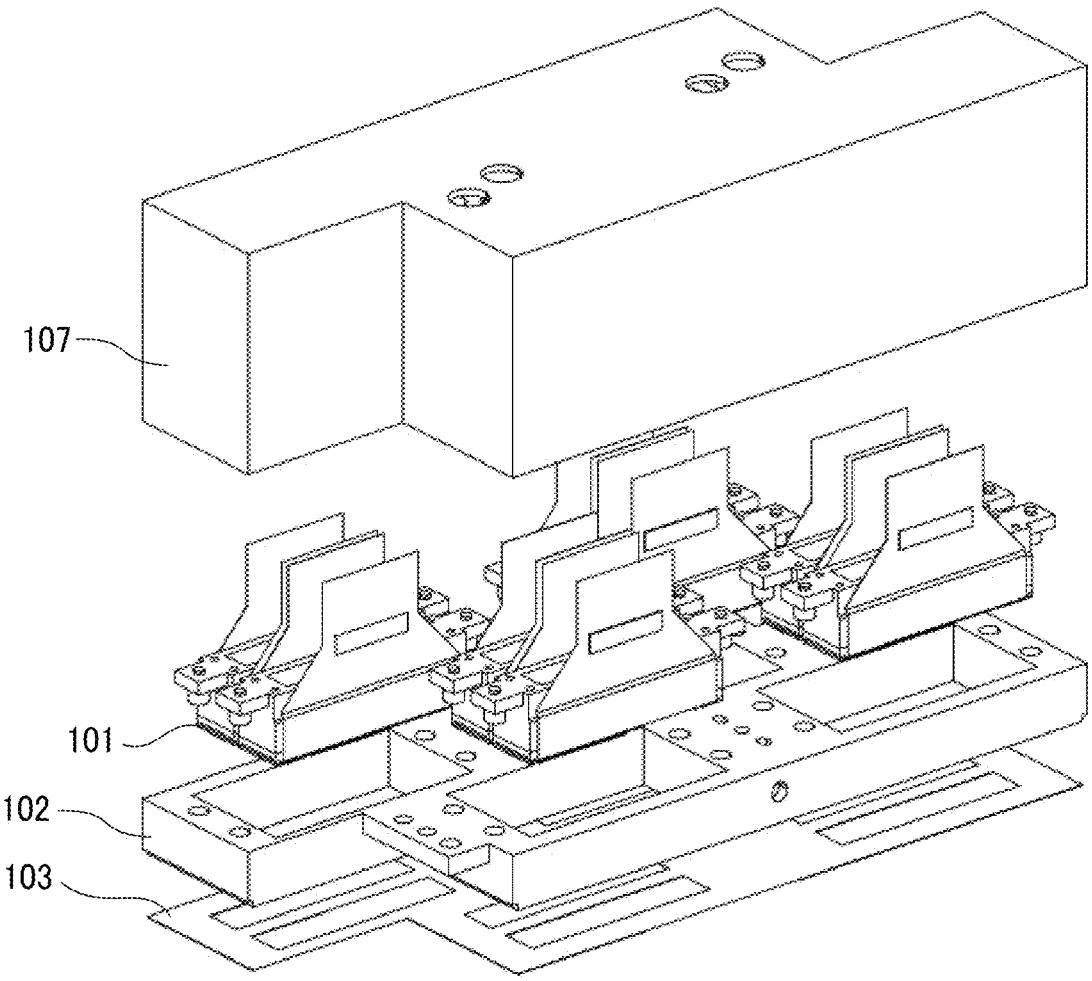
FIG. 21 is an exploded perspective view of the head, a base, and a cover of the head module illustrated in FIG. 18.

FIGS. 18 to 21 illustrate an example of a head module according to an embodiment of the present disclosure. FIG. 18 is a cross-sectional view of a portion of a head module 100 according to the embodiment of the present disclosure in the transverse direction of a head 101. FIG. 19 is an exploded perspective view of the head module 100 illustrated in FIG. 18. FIG. 20 is an exploded perspective view of the head module 100 viewed from a nozzle surface side of the head module 100 module illustrated in FIG. 18. FIG. 21 is an exploded perspective view of the head 101, a base 102, and a cover 103 of the head module 100 module illustrated in FIG. 18.

The head module 100 includes a plurality of heads 101 as the heads to discharge liquid, a base 102, a cover 103, a heat radiating member 104, a manifold 105, a printed circuit board 106 (PCB), and a module case 107.

Each of the heads 101 includes a nozzle plate 10, an individual channel plate 20, a diaphragm 30, an intermediate channel plate 50, and a common channel member 70, for example. Nozzles 11 are formed in the nozzle plate 10. The individual channel plate 20 includes individual chambers 21 communicating with the nozzles 11, respectively. The diaphragm 30 includes piezoelectric elements 40. The intermediate channel plate 50 is laminated on the diaphragm 30. The common channel member 70 is laminated on the intermediate channel plate 50.

The individual channel plate 20 includes a supply-side individual channel 22 communicating with the individual chamber 21 and a recovery-side individual channel 24 communicating with the individual chamber 21 together with the individual chamber 21.

The intermediate channel plate 50 forms a supply-side intermediate individual channel 51 and a recovery-side intermediate individual channel 52. The supply-side intermediate individual channel 51 communicates with the supply-side individual channel 22 via an opening 31 of the diaphragm 30. The recovery-side intermediate individual channel 52 communicates with the recovery-side individual channel 24 via an opening 32 of the diaphragm 30.

The common channel member 70 forms a supply-side common channel 71 and a recovery-side common channel 72. The supply-side common channel 71 communicates with the supply-side intermediate individual channel 51. The recovery-side common channel 72 communicates with the recovery-side intermediate individual channel 52. The supply-side common channel 71 communicates with a supply port 81 via a channel 151 of the manifold 105. The recovery-side common channel 72 communicates with a recovery port 82 via a channel 152 of the manifold 105.

The printed circuit board 106 and the piezoelectric element 40 of the head 101 are connected via a flexible wiring 90, and drive integrated circuits 91 (drive ICs) are mounted on the flexible wirings 90.

In the present disclosure, a plurality of heads 101 are mounted onto the base 102 with a space provided between the heads 101 as illustrated in FIG. 20. The head 101 is inserted into the opening 121 in the base 102, and the peripheral end of the nozzle plate 10 of the head 101 is bonded and fixed to the cover 103 bonded and fixed to the base 102 to attach the head 101 to the base 102. A flange portion 70*a* provided outside the common channel member 70 of the head 101 is bonded and fixed to the base 102 (see FIG. 19).

A structure of fixing the head 101 to the base 102 is not limited. For example, the head 101 may be fixed to the base 102 with bonding, caulking, screwing, or the like.

Here, the base 102 is preferably formed of a material having a low coefficient of linear expansion. For example, 42 alloy (alloy) with nickel added to iron or invar material may be used for forming the base 102. In the present embodiment, Invar material is used for forming the base 102. Thus, the head 101 of the present disclosure can reduce a displacement of the nozzles 11 from a predetermined nozzle position to reduce a displacement of a landing position of the liquid discharged from the nozzles 11 of the head 101 even if the head 101 generates heat so that the temperature of the base 102 increases since an amount of a thermal expansion of the base 102 is small.

Similarly, the nozzle plate 10, the individual channel plate 20, and the diaphragm 30 are formed of a silicon single-crystal substrate, and the coefficient of linear expansions of the base 102, the nozzle plate 10, the individual channel plate 20, and the diaphragm 30 are made substantially the same.

Thus, the head 101 of the present disclosure can reduce the displacement of relative positions of the nozzles 11 due to thermal expansion.

Figure 22:
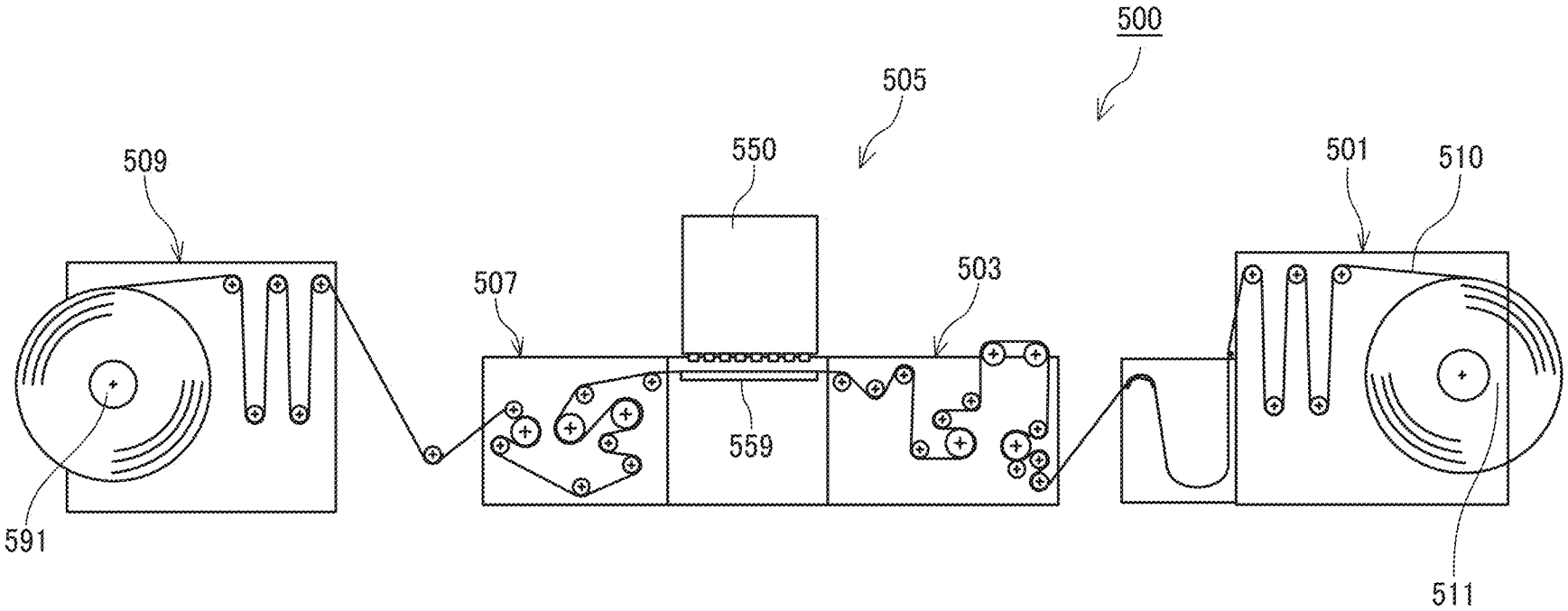
FIG. 22 is a schematic side view of a liquid discharge apparatus according to an embodiment of the present disclosure.
Figure 23:
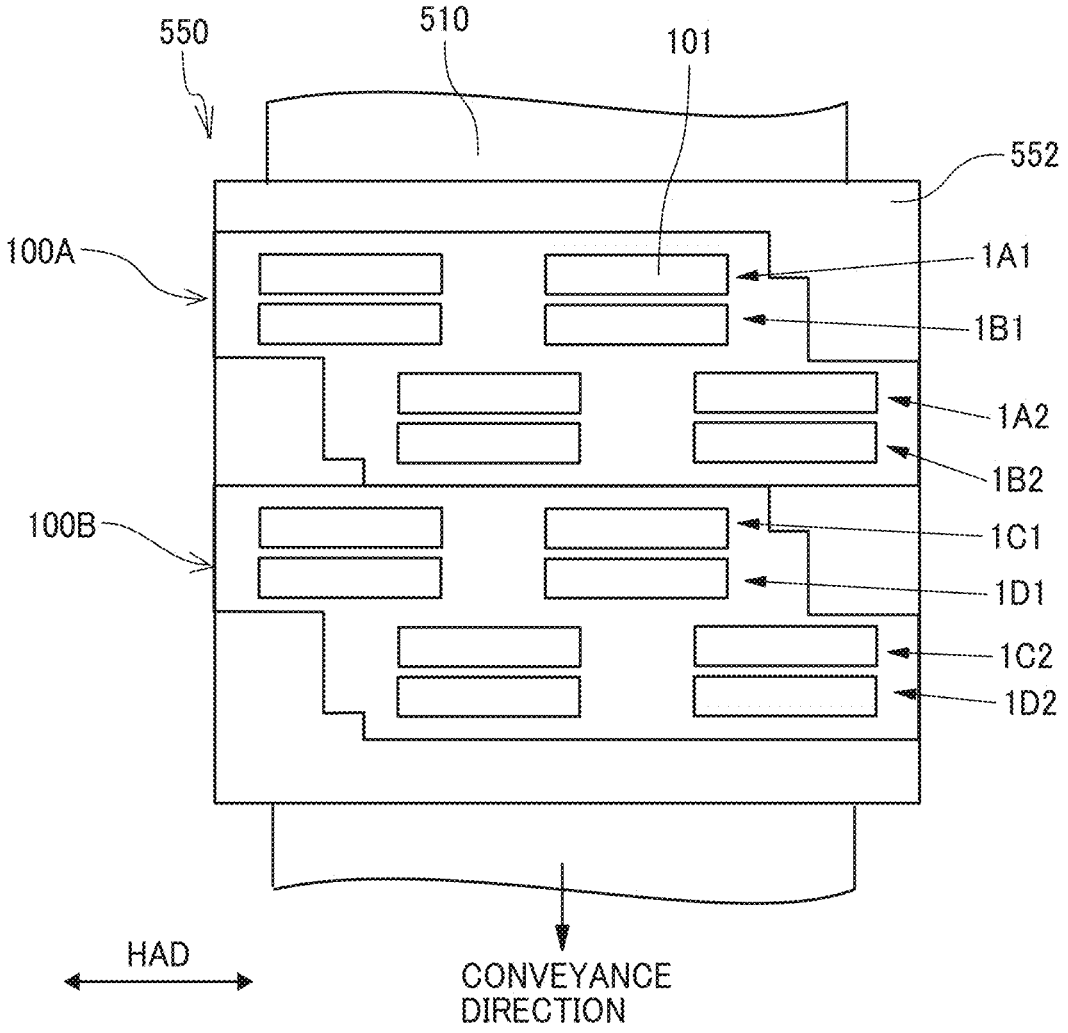
FIG. 23 is a plan view of a head device of the liquid discharge apparatus of FIG. 22.

FIGS. 22 and 23 illustrate an example of a liquid discharge apparatus according to an embodiment of the present disclosure. FIG. 22 is a side view of a liquid discharge apparatus according to an embodiment of the present disclosure. FIG. 23 is a plan view of a head unit of the liquid discharge apparatus of FIG. 22 according to an embodiment of the present disclosure.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a drier unit 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the drier unit 507, and wound around a take-up roller 591 of the ejector 509.

In the printing unit 505, the continuous medium 510 is conveyed opposite the head unit 550 on a conveyance guide 559. The head unit 550 discharges a liquid from the nozzles 11 of the head 101 to form an image on the continuous medium 510.

Here, as illustrated in FIG. 23, the head unit 550 includes two head modules 100A and 100B according to an embodiment of the present disclosure on a common base 552.

The head module 100A includes head arrays 1A1, 1B1, 1A2, and 1B2. Each of the head arrays 1A1, 1B1, 1A2, and 1B2 includes a plurality of heads 101 arranged in a direction perpendicular to a conveyance direction of the continuous medium 510. The direction perpendicular to the conveyance direction of the continuous medium 510 is also referred to as a "head array direction" indicated by arrow "HAD" in FIG. 23. The conveyance direction of the continuous medium 510 is indicated by arrow "CONVEYANCE DIRECTION" in FIG. 23.

The head module 100B includes head arrays 1C1, 1D1, 1C2, and 1D2. Each of the head arrays 1C1, 1D1, 1C2, and 1D2 includes a plurality of heads 101 arranged in the head array direction HAD. The head 101 in each of the head arrays 1A1 and 1A2 of the head module 100A discharges liquid of the same color.

Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

The head module according to an embodiment of the present disclosure can be formed together with functional parts and mechanisms as a single unit (integrated unit) to constitute a liquid discharge device. For example, at least one of the configurations of the head module, a head tank, a carriage, a supply unit, a maintenance unit, a main scan moving unit, and the liquid circulation device may be combined together to form the liquid discharge device.

Examples of the "single unit" include a combination in which the head module and one or more functional parts and devices are secured to each other through, e.g., fastening, bonding, or engaging, and a combination in which one of the head module and the functional parts and devices is movably held by another. Further, the head module, the functional parts, and the mechanism may be configured to be detachable from each other.

The term "liquid discharge apparatus" used herein is an apparatus including the head module or a liquid discharge device to drive the head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

Further, "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The terms "image formation", "recording", "printing", "image printing", and "fabricating" used herein may be used synonymously with each other.

Although the preferred embodiments of the present disclosure have been described above, the present disclosure is not limited to the embodiments described above, and a variety of modifications can naturally be made within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head module comprising:

a liquid discharge head configured to discharge a liquid; and a nozzle cover to which the liquid discharge head is bonded, wherein the liquid discharge head includes:

a nozzle plate including a nozzle through which the liquid is discharged and a first bonding surface; and an actuator substrate including an actuator configured to generate energy to discharge the liquid from the nozzle, and wherein the nozzle cover includes an opening, configured to expose the nozzle in the nozzle plate, and a second bonding surface, to be bonded to the first bonding surface of the nozzle plate with a first adhesive and a second adhesive, different from the first adhesive, and wherein at least one of the first bonding surface and the second bonding surface includes:

a first region on which the first adhesive is applied;

a second region on which the second adhesive is applied; and a third region, disposed between the first region and the second region, the third region having a water repellency relatively higher than a water repellency of the first region and a water repellency of the second region.

2. The head module of claim 1, further comprising a plurality of liquid discharge heads, the plurality of liquid discharge heads including the liquid discharge head, wherein the plurality of liquid discharge heads are attached to the nozzle cover.

3. A head device including a plurality of head modules, the plurality of head modules including the head module of claim 2.

4. A liquid discharge apparatus comprising the head device of claim 3.

5. The head module of claim 1, wherein at least one of the first bonding surface and the second bonding surface includes:

an outer first region, arranged on an opposite side of the third region and arranged across the first region, an inner second region arranged on an opposite side of the third region and arranged across the second region, and the outer first region and the inner second region each having a water repellency relatively higher than the water repellency of the first region and the water repellency of the second region.

6. The head module of claim 1, wherein one of the first bonding surface and the second bonding surface includes two or more stepped surfaces having relatively different distances from another of the first bonding surface and the second bonding surface, and the first region and the second region are arranged at relatively different stepped surfaces.

7. The head module of claim 1, wherein the first adhesive is an adhesive cured in a room temperature environment, and the second adhesive is a thermosetting adhesive.

8. A head module comprising:

a liquid discharge head configured to discharge a liquid; and a nozzle cover, to which the liquid discharge head is bonded, wherein the liquid discharge head includes:

a nozzle plate, including a nozzle, through which the liquid is discharged; and an actuator substrate, including an actuator, configured to generate energy to discharge the liquid from the nozzle and a first bonding surface, and wherein the nozzle cover includes an opening, configured to expose the nozzle in the nozzle plate, and a second bonding surface, to be bonded to the first bonding surface of the actuator substrate with a first adhesive and a second adhesive, different from the first adhesive, and wherein at least one of the first bonding surface and the second bonding surface includes:

a first region on which the first adhesive is applied;

a second region on which the second adhesive is applied; and a third region, disposed between the first region and the second region, the third region having a water repellency relatively higher than a water repellency of the first region and a water repellency of the second region.

9. The head module of claim 8, further comprising a plurality of liquid discharge heads, the plurality of liquid discharge heads including the liquid discharge head, wherein the plurality of liquid discharge heads is attached to the nozzle cover.

10. A head device, including a plurality of head modules, the plurality of head modules including the head module according to claim 9.

11. A liquid discharge apparatus comprising the head device according to claim 10.

12. The head module of claim 8, wherein at least one of the first bonding surface and the second bonding surface includes:

an outer first region, arranged on an opposite side of the third region and arranged across the first region, an inner second region arranged on an opposite side of the third region and arranged across the second region, and the outer first region and the inner second region each having a water repellency relatively higher than the water repellency of the first region and the water repellency of the second region.

13. The head module of claim 8, wherein one of the first bonding surface and the second bonding surface includes two or more stepped surfaces having relatively different distances from another of the first bonding surface and the second bonding surface, and the first region and the second region are arranged at relatively different stepped surfaces.

14. The head module of claim 8, wherein the first adhesive is an adhesive cured in a room temperature environment, and the second adhesive is a thermosetting adhesive.

* * * * *